US007597324B2

(12) United States Patent
Obuchi et al.

(10) Patent No.: US 7,597,324 B2
(45) Date of Patent: Oct. 6, 2009

(54) SHEET-STACKING APPARATUS AND IMAGE-FORMING APPARATUS

(75) Inventors: Yusuke Obuchi, Abiko (JP); Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 11/849,967

(22) Filed: Sep. 4, 2007

(65) Prior Publication Data

US 2008/0054558 A1 Mar. 6, 2008

(30) Foreign Application Priority Data

Sep. 6, 2006 (JP) ..... 2006-242076
Aug. 21, 2007 (JP) ..... 2007-214886

(51) Int. Cl.
*B65H 39/10* (2006.01)
*B65H 29/00* (2006.01)

(52) U.S. Cl. ..... 271/288; 271/298; 271/279; 271/299; 271/289

(58) Field of Classification Search ..... 271/218, 271/288, 292, 299, 287, 279, 289, 291
See application file for complete search history.

(56) References Cited

U.S. PATENT DOCUMENTS 5,096,181 A * 3/1992 Menon et al. ..... 271/157
5,460,479 A * 10/1995 Neumann et al. ..... 414/789.5
5,662,323 A * 9/1997 Kernen ..... 271/218
6,860,708 B2 * 3/2005 Lindquist ..... 414/792.7

FOREIGN PATENT DOCUMENTS

JP 06016325 A * 1/1994
JP 06-144682 5/1994
JP 06-074108 9/1994
JP 07-012366 3/1995
JP 09-216761 8/1997
JP 09216761 A * 8/1997
JP 09-255213 9/1997
JP 2001-89005 4/2001
JP 2006-124052 5/2006

* cited by examiner

*Primary Examiner*—Patrick H Mackey
*Assistant Examiner*—Patrick Cicchino
(74) *Attorney, Agent, or Firm*—Canon USA Inc IP Div

(57) ABSTRACT

A sheet-stacking apparatus includes a gripper configured to convey a sheet, two stacker trays stacking sheets arranged in a row, and a support member configured to separately elevate the two stacker trays. The stacker tray is selected according to a sheet length.

14 Claims, 21 Drawing Sheets

SHEET-STACKING APPARATUS AND IMAGE-FORMING APPARATUS

BACKGROUND OF THE INVENTION

1. Field of the Invention

The present invention relates to a sheet-stacking apparatus configured to continuously stack a large number of sheets while sheets already stacked are being removed and, more particularly, to an apparatus effectively using a sheet-stacking space and an image-forming apparatus having such a sheet-stacking apparatus.

2. Description of the Related Art

In recent years, together with the technological advancement in image-forming techniques, an image-forming apparatus configured to form an image on a sheet has become capable of discharging sheets from its main body in larger quantities at higher speed. Accordingly, a sheet-stacking apparatus which is connected to a main body of the image-forming apparatus and stacks sheets discharged from the apparatus main body is required to be capable of stacking a large number of sheets. A sheet-stacking apparatus satisfying such a request (hereinafter referred to as "stacker apparatus") is discussed in Japanese Patent Application Laid-Open No. 2006-124052.

This conventional stacker apparatus is shown in FIG. 21. A stacker apparatus 500 receives a sheet discharged from a main body of an image-forming apparatus at an inlet roller 501 and then passes the sheet over to a gripper 503 using a conveyance roller pair 502. The gripper 503 holds and conveys the sheet so that the leading edge of the sheet abuts against a leading edge stopper 504. At the leading edge stopper 504, the sheet is released from the gripper 503 and falls onto a stacker tray 505. At this time, the sheet falls between the leading edge stopper 504 and a trailing edge stopper 508. Then, the leading edge and the trailing edge of the sheet on the stacker tray 505 are aligned. Further, if necessary, the sheet is aligned by a width alignment device (not shown) in the width direction which is perpendicular to the sheet-conveyance direction so that the side end of the sheet is aligned. Furthermore, with consideration given to a case when the sheet is curled or when there is a space between sheets, the sheets are pressed against the stacker tray 505 by a leading edge pressing member 506 and a trailing edge pressing member 507 in every predetermined number of sheets so that the stacked sheets do not interfere with the subsequent sheet.

The conventional stacker apparatus has only one stacker tray 505 whose size is adjusted to a maximum length of a sheet. Accordingly, even when a small sheet is set (for example, B5 size) and two sheet stacks can be arranged side-by-side on the stacker tray 505, only one sheet stack is possible. Accordingly, when a small sheet is stacked, the conventional stacker apparatus has an empty space X within the stacker apparatus. Thus, the space in the conventional stacker apparatus is not efficiently used. Further, the conventional stacker apparatus has to be stopped while a user removes the sheets, thus a large number of sheets cannot be continuously stacked.

Accordingly, a conventional image-forming apparatus equipped with such a stacker apparatus is unable to continuously stack a large number of sheets and has low efficiency in image forming.

SUMMARY OF THE INVENTION

The present invention is directed to a sheet-stacking apparatus capable of continuously stacking a large number of sheets without stopping operation and having in a sheet discharging direction a plurality of stacking portions which can be selected according to a size of a sheet, and thus allowing effective use of a space in the apparatus.

Further, the present invention is directed to an image-forming apparatus capable of continuously forming images with a sheet-stacking apparatus capable of stacking a large number of sheets.

The present invention in its first aspect provides a sheet-stacking apparatus as specified in claims 1 to 14.

The present invention in its second aspect provides an image-forming apparatus as specified in claim 15.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

(Image-Forming Apparatus)

Figure 1:
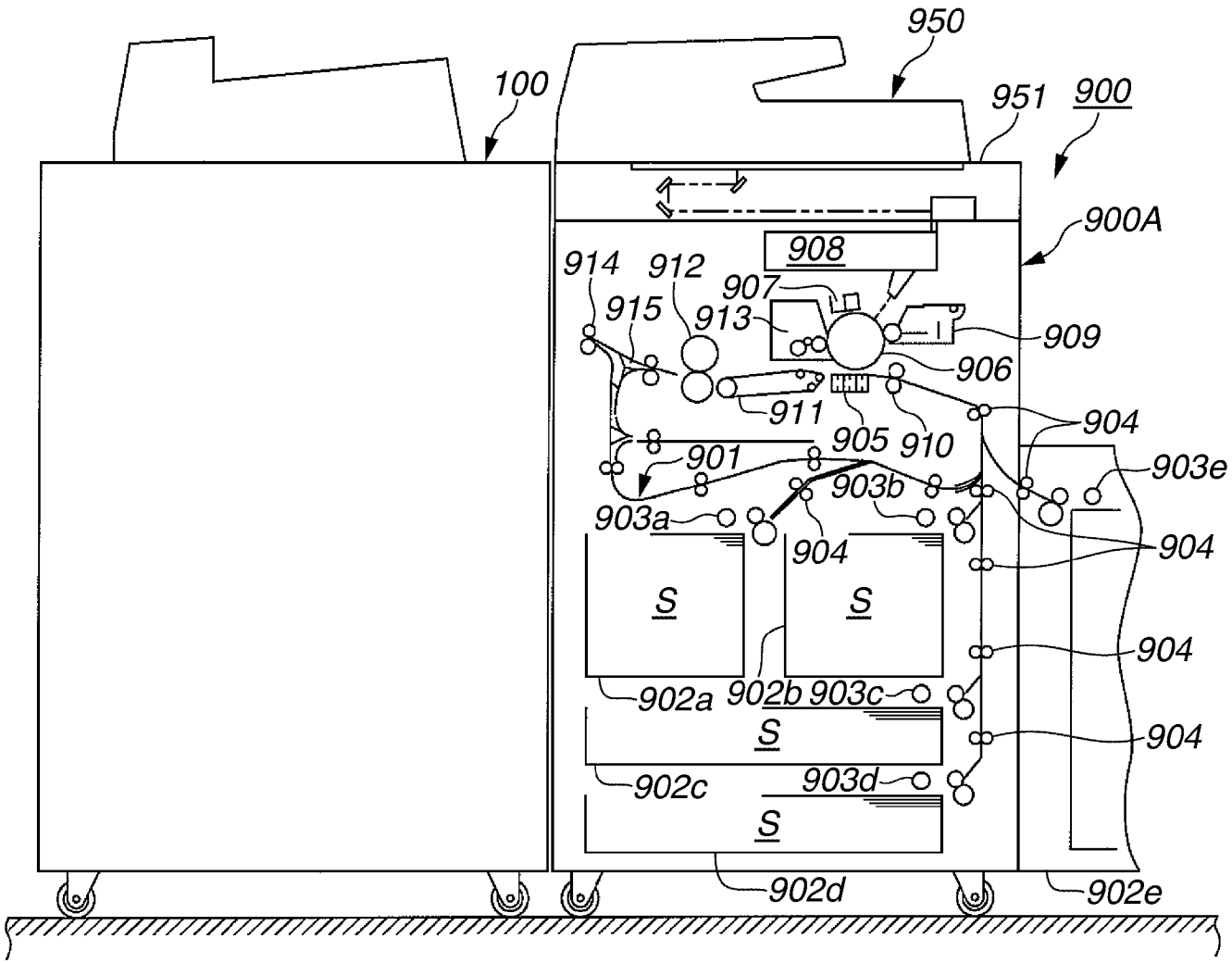
FIG. 1 is a cross-sectional view of an image-forming apparatus in a sheet-conveyance direction according to an exemplary embodiment of the present invention.

FIG. 1 is a cross-sectional view of an image-forming apparatus in a sheet-conveyance direction according to an exemplary embodiment of the present invention. An image-forming apparatus 900 includes an apparatus main body 900A having a sheet-stacking apparatus (hereinafter referred to as "stacker apparatus") 100. The stacker apparatus 100 can be optionally connected to the apparatus main body 900A, however, it can also be incorporated in the apparatus main body 900A.

The apparatus main body 900A has an image reader 951 and an auto document-feeding apparatus 950 mounted on the top. A sheet S set in one of sheet cassettes 902*a* through 902*e* is conveyed to a registration roller pair 910 by feeding rollers 903*a* through 903*e* and by conveyance roller pairs 904.

A photosensitive drum 906, which is described later, forms an image-forming unit together with a developing unit 909 and a transfer unit 905. The photosensitive drum 906 is exposed by an exposure unit 908 after it is charged by a primary charging unit 907 so that digital data of the document scanned by the image reader 951 is formed as an electrostatic latent image. Then, the developing unit 909 develops the latent image on the photosensitive drum 906 with toner to make a toner image from the electrostatic latent image.

Subsequently, the sheet is conveyed by the registration roller pair 910 to a space between the photosensitive drum 906 and the transfer unit 905 to be aligned with the toner image. Then, the transfer unit 905 transfers the toner image from the photosensitive drum 906 to the sheet. Unnecessary matters such as remaining toner on the photosensitive drum 906 which was not transferred are scraped off by a blade of a cleaning apparatus 913. As a result, the photosensitive drum 906 is cleaned and ready for the next image forming.

The sheet having the transferred toner image is conveyed by a conveying belt 911 to a fixing unit 912 where the toner image is fixed with heat and pressure from a heating roller and a pressure roller of the fixing unit 912. The image-fixed sheet is then conveyed to the stacker apparatus 100 by a discharge roller pair 914 or conveyed to a turnover apparatus 901 by a switching member 915 to have a toner image formed on the other side of the sheet.

(Control Block Diagram)

Figure 2:
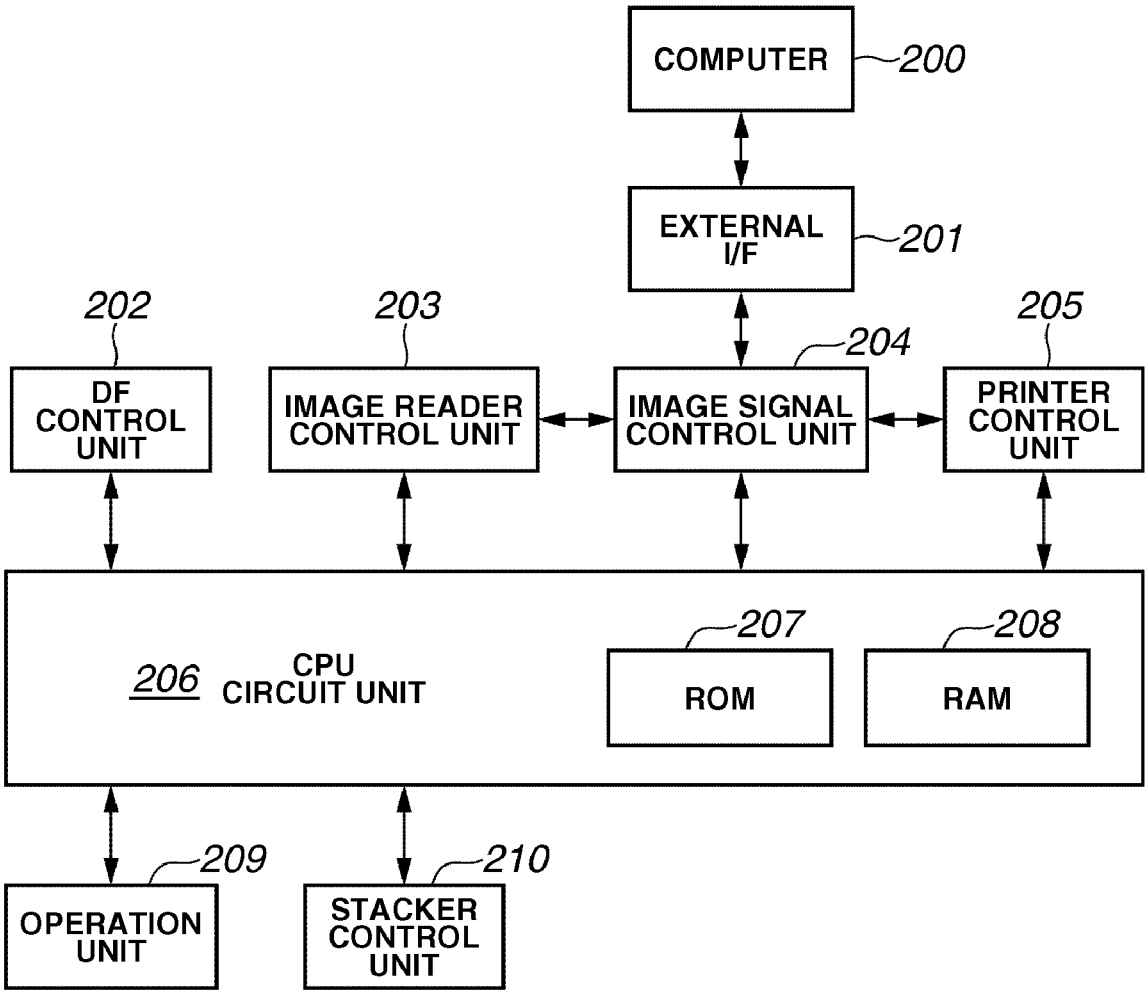
FIG. 2 is a block diagram illustrating controller of the image-forming apparatus including a sheet-stacking apparatus.

FIG. 2 is a block diagram illustrating controller of the image-forming apparatus. A CPU circuit unit 206 includes a central processing unit (CPU) (not shown), a read only memory (ROM) 207, and a random access memory (RAM) 208. A control program stored in the ROM 207 controls blocks 201, 202, 203, 204, 205, 209, and 210 overall. The RAM 208 which temporarily stores control data, is also used as a working area during processing. In use, the control program stored in the ROM is executed by the CPU and controls the image-forming apparatus and stacker apparatus to perform the methods described below.

A document-feeding (DF) control unit 202 controls drive of the auto document-feeding apparatus 950 based on an instruction from the CPU circuit unit 206. An image-reader-control unit 203 controls drive of a scanner unit and an image sensor of the aforementioned image reader 951. An analog image signal output from the image sensor is transmitted to an image-signal-control unit 204 by the image-reader-control unit 203.

The image-signal-control unit 204 converts the analog image signal output from the image sensor to a digital signal, processes and converts the digital signal to a video signal. The video signal is output to a printer-control unit 205 which is a controller of the apparatus main body. Further, the image-signal-control unit 204 processes and converts a digital image signal sent from a computer 200 through an external I/F 201, to a video signal, which is output to the printer-control unit 205. The processing operation performed by the image-signal-control unit 204 is controlled by the CPU circuit unit 206.

Based on the video signal which is input, the printer-control unit 205 drives the aforementioned exposure unit 908.

An operation unit 209 includes a plurality of keys configured to set various functions concerning image forming, and a display unit configured to display information showing a state of the setting. The operation unit 209 outputs a key signal which corresponds to each operation of the keys, to the CPU circuit unit 206. Further, the operation unit 209 displays information corresponding to a signal output from the CPU circuit 206 on its display portion.

A stacker-control unit 210, which is mounted on the stacker apparatus 100, controls drive of the whole stacker apparatus by exchanging information with the CPU circuit unit 206. The control performed by the stacker-control unit 210 will be described later.

(Basic Operation of Stacker Apparatus)

Figure 3:
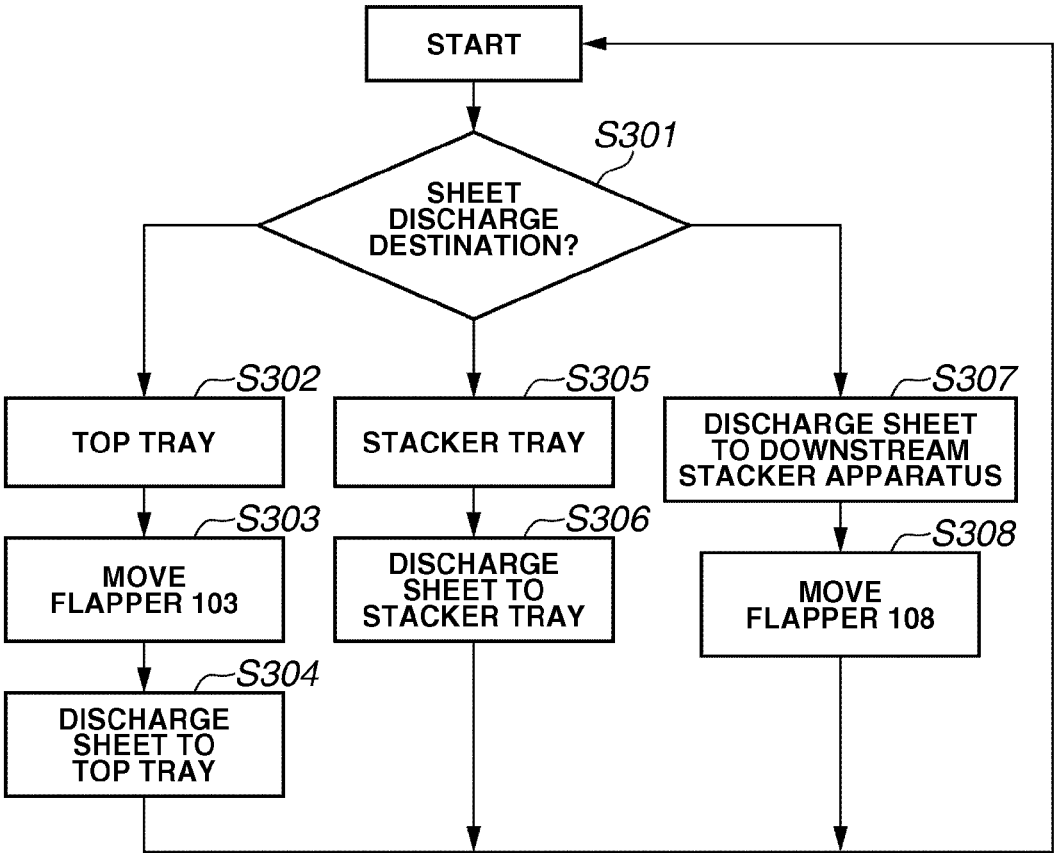
FIG. 3 is a flowchart illustrating a basic operation of a stacker apparatus.

Basic operation of the stacker apparatus will be described based on the flowchart shown in FIG. 3 and the cross-sectional view of the stacker apparatus illustrated in FIG. 4.

A sheet discharged from the apparatus main body 900A of the image-forming apparatus 900 (FIG. 1) is conveyed to the stacker apparatus 100 by an inlet roller pair 101 of the stacker apparatus 100 and then conveyed to a switching member 103 by a conveyance roller pair 102. Before the sheet is conveyed, information about the sheet is sent to the stacker-control unit 210 (FIG. 2) from the CPU circuit unit 206 of the image-forming apparatus 900 (step S301).

The sheet information includes sheet size, sheet type, sheet orientation, and destination of the sheet. The sheet orientation information includes whether the sheet is portrait or landscape with respect to the sheet-conveying direction. Accordingly, from the information about sheet size and sheet orientation, information about a length of the sheet can be obtained. The sheet length information can also be obtained directly from operation by a user or through an external information apparatus such as a personal computer. Further, the information can also be obtained from a sensor provided on a sheet path.

When the destination of the sheet is a top tray 106 (step S302), the switching member 103 is controlled by a solenoid (not shown) and a tip of the switching member 103 is switched downward in a direction shown by a broken line (step S303) to guide the sheet to a conveyance roller pair 104.

The sheet is then discharged by a discharge roller pair 105 and stacked on the top tray 106 (step S304).

When the destination of the sheet is the stacker tray 112*a* or 112*b* (step S305), the sheet conveyed by the conveyance roller pair 102 is guided to the switching member 103. The switching member 103 is controlled by a solenoid (not shown) and the tip of the switching member 103 is switched upward in a direction shown by a solid line. By a discharge roller pair 110, the sheet is passed onto grippers 114*a* and 114*b* that constitutes the conveying portion. Then, the sheet is conveyed selectively onto the stacker tray 112*a* or 112*b* serving as a stacking portion, or stacked across on both trays depending on the length of the sheet (step S306). In other words, different sheets are stacked on each of the stacker trays individually as a second mode, or a same sheet is stacked across on the plural of the stacker trays as a first mode. The conveying operation will be described below.

When the destination of the sheet is a stacker apparatus (not shown) located further downstream (step S307), the outlet switching member 108 is controlled so that its upper end is switched in the right direction as shown in a broken line (step S308). Then, the sheet conveyed by the conveyance roller pair 102 is conveyed by the conveyance roller pair 107, and after being guided by a delivery roller pair 109, the sheet is conveyed to the stacker apparatus.

(Conveying Sheets on Stacker Tray)

An operation of conveying sheets onto a stacker tray will now be described referring to FIGS. 4 through 14. The stacker trays 112*a* and 112*b* are supported by members 131*a* and 131*b* which move up and down driven by a driving device (not shown) The stacker trays 112*a* and 112*b* are arranged in a row so that they can move separately in the directions shown in arrows C, D, E, and F in FIG. 4. A driving device (not shown) and the support members 131*a* and 131*b* form an elevating device.

A guiding unit 115 serving as a guiding unit is mounted on a slide shaft 118. A frame 127 of the guiding unit 115 can slide along the slide shaft 118. The guiding unit 115 is movable in the directions shown in arrows A and B by a driving device (not shown). The frame 127 of the guiding unit 115 has a stopper 121, a taper portion 122, and a knurled belt 116. The sheet is guided to the stopper 121 by the taper portion 122 and the leading edge of the sheet abuts against the stopper 121. The knurled belt 116 has elasticity and guides in the sheet to the stopper 121.

The taper portion 122 serving as a guide member and the knurled belt 116 serving as an elastic rotating body constitute the guiding unit. The sheet guided by the taper portion 122 and the knurled belt 116 is aligned at a predetermined position as its leading edge abuts against the stopper 121.

The knurled belt 116 is rotated counterclockwise by a driving device (not shown) and guides in the sheet between the knurled belt 116 and the stacker tray 112*a* (or stacker tray 112*b*) so that the leading edge of the sheet abuts against the stopper 121. A sheet-surface-detection sensor 117 in the guiding unit 115 detects the top surface of the sheet stack to keep a constant distance between the guiding unit 115 and the top surface of the sheet stack.

The top surface of the sheet stack on the stacker trays 112*a* and 112*b* can be detected not only by a sheet-surface-detection sensor 117 but also by sheet-surface-detection sensors 113*a* and 113*b* provided on a main body of the stacker apparatus 100. The sheet-surface-detection sensors 113*a* and 113*b* are used when sheets are stacked across the two stacker trays 112*a* and 112*b* in a case where the sheets have a portrait orientation (i.e., the sheets are longer in a direction conveyed by the grippers). Further, the sheet-surface-detection sensors 113*a* and 113*b* are arranged so that the top surface of the sheet stack on the stacker tray 112*a* has a same height as the top surface of the sheet stack on the stacker tray 112*b*.

The grippers 114*a* and 114*b* which grip the leading edge of the sheet to convey the sheet are attached to a drive belt 130. The grippers are urged in a gripping direction by a torsion coil spring (not shown) and can be opened by a driving device (not shown). The gripper can also be formed by two elastic bodies which are made from, for example, sponge arranged above and below a member having a V-shaped opening. Thus, the sheet is held by the elastic bodies.

The conveyed sheets are stacked in the stacker trays 112*a* and 112*b* arranged in row. These trays wait at their home position while the top surface of the sheet stack can be detected by sheet-surface-detection sensors 113*a* and 113*b*.

The sheet-surface-detection sensors 113*a* and 113*b* function as a home-position-detection sensor for stacker trays 112*a* and 112*b* at initial operation but function as a sheet-surface-detection sensor for stacker trays 112*a* and 112*b* during stacking operation.

Figure 5:
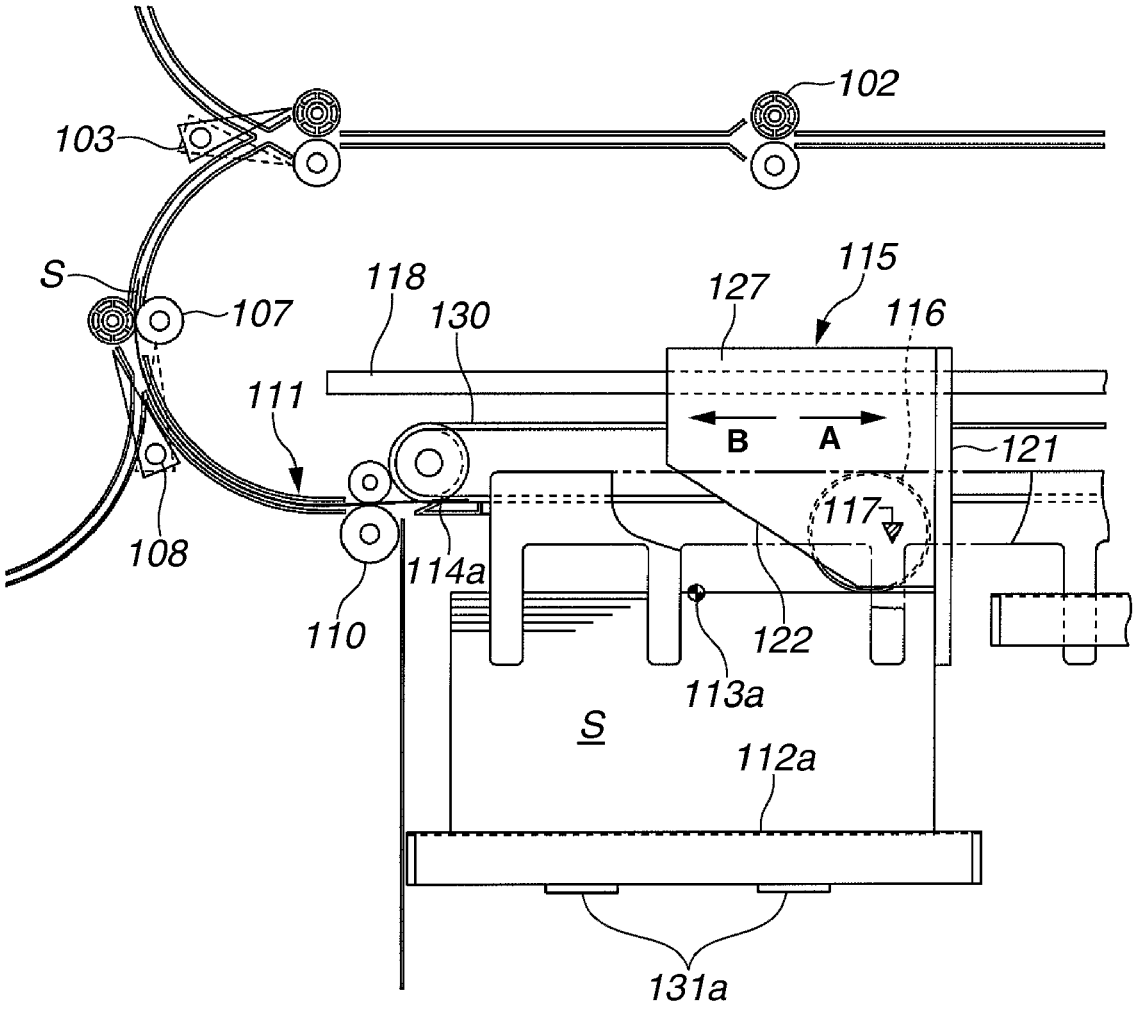
FIG. 5 illustrates movement of a sheet when it is stacked on a stacker tray on the left. The sheet is held by a gripper.
Figure 6:
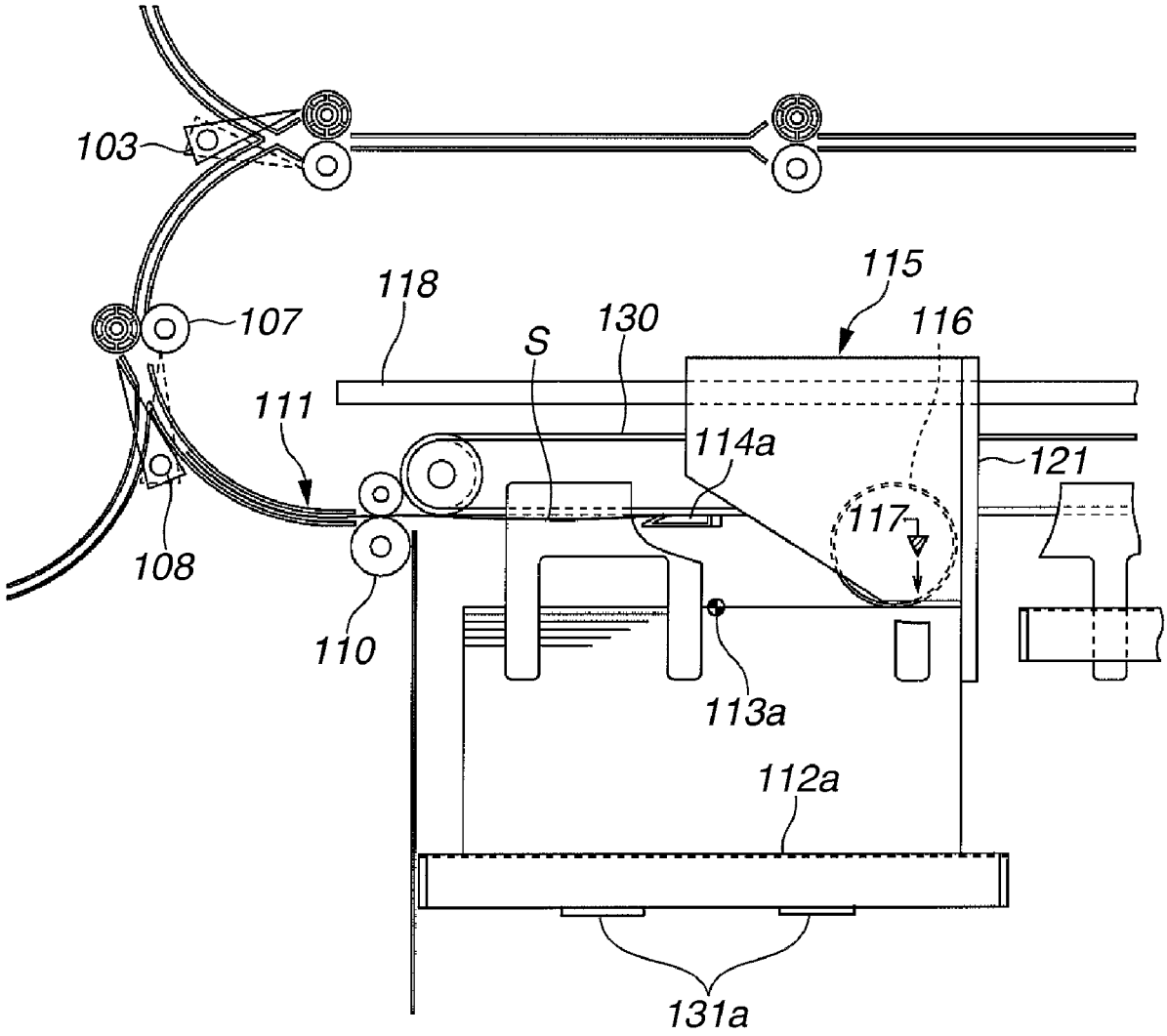
FIG. 6 illustrates movement of the sheet conveyed and discharged by a guiding unit.

As shown in FIG. 5, the sheet S discharged from the apparatus main body 900A (FIG. 1) of the image-forming apparatus 900 is conveyed to the discharge roller pair 110. Then, the passing of the leading edge of the sheet is detected by a timing sensor 111 located upstream of the discharge roller pair 110. According to this timing, the drive belt 130 starts rotating so that the gripper 114*a* in a waiting state grips the leading edge of the sheet S while the sheet is conveyed. After that, the gripper 114*a* moves toward the guiding unit 115 while gripping the sheet (FIG. 6). The drive belt 130 and the grippers 114*a* and 114*b* constitute the conveying portion.

Figure 7:
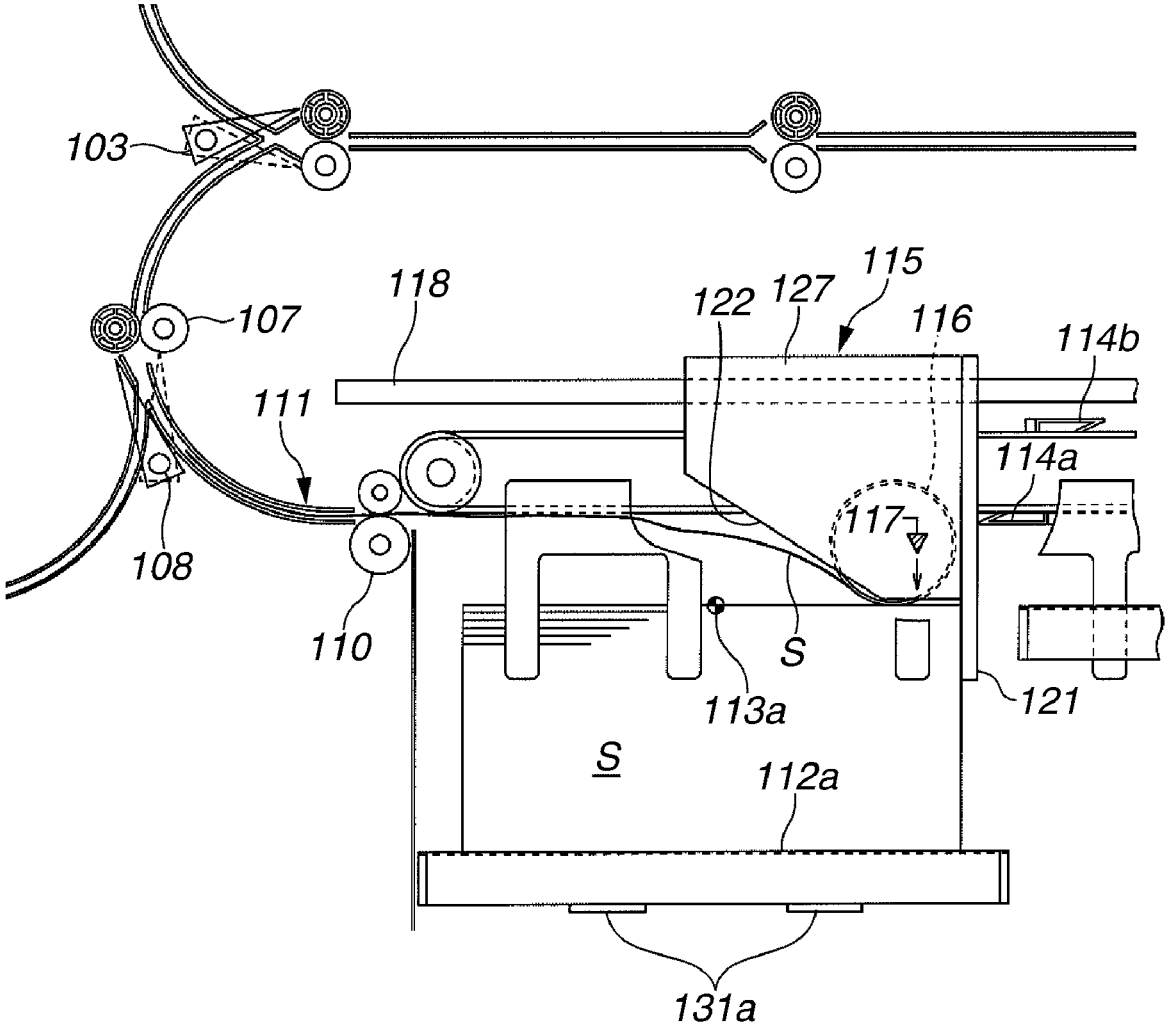
FIG. 7 illustrates movement of the sheet just before it is stacked on the sheets already stacked after being guided by a taper portion of the guiding unit.
Figure 8:
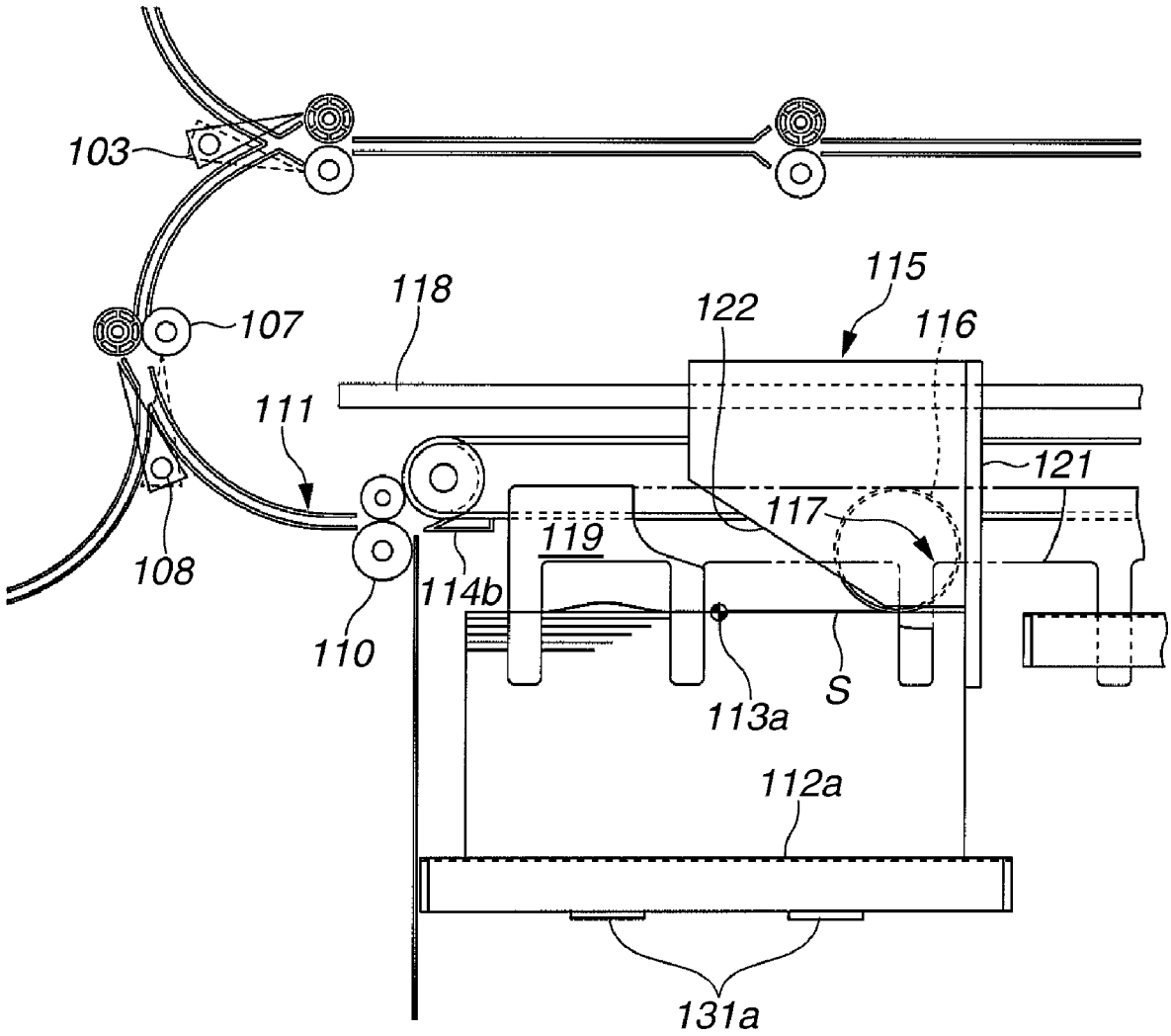
FIG. 8 illustrates movement of the sheet stacked on the sheets already stacked.

Then, as shown in FIG. 7, when the gripper 114*a* passes the taper portion 122 of the guiding unit 115, the sheet S is released from the gripper 114*a*. Subsequently, under the influence of the conveyance force, the sheet is guided by the taper portion 122 to the stacker tray 112*a*. Then, the sheet is conveyed between the knurled belt 116 and the stacker tray 112*a* (or, onto atop surface if sheets are stacked) by the knurled belt 116 until its leading edge abuts against the stopper 121 (FIG. 8). As a result, the sheet is stacked onto the stacker tray 112*a* with its leading edge aligned.

Then, an alignment plate 119 jogs in a direction perpendicular to the sheet-conveyance direction (sheet-width direction), and aligns the side end of the sheets (width alignment).

The sheet-surface-detection sensors 117 and 113*a* continuously monitor the top surface of the sheet stack on the stacker tray 112*a*. When a distance between the knurled belt 116 of the guiding unit 115 and the sheet becomes shorter than a predetermined distance, a stacker tray driving device (not shown) moves the stacker tray 112*a* down a predetermined distance. In this way, the distance between the sheet and the knurled belt 116 is kept constant.

The stacker apparatus 100 stacks the sheet one after another on the stacker tray 112*a* with the grippers 114*a* and 114*b*. The grippers 114*a* and 114*b* convey and discharge the sheets alternately while the drive belt 130 is circulating.

When it is detected that the sheets stacked on the stacker tray 112*a* reach a predetermined stack height, the stacker tray 112*a* is determined to be fully loaded. To detect the stack height, the stacker-control unit 210 (FIG. 2) counts a number of sheets conveyed from the discharge roller pair 110 and the discharge timing of the sheets is detected by the timing sensor 111. Whether the predetermined stack height is reached can also be determined by a detecting a position of the stacker tray 112*a* and a position of the top surface of the sheet stack.

When the sheets on the stacker tray 112*a* reach the predetermined stack height, the stacker-control unit 210 (FIG. 2) determines that the stacker tray 112*a* is fully loaded, moves the stacker tray 112*a* down, and mounts the stacker tray 112*a* together with the stack of sheets onto the dolly 120. After that, the guiding unit 115 moves in the direction of the arrow A to the empty stacker tray 112*b*. The stacker tray 112*b* waits until the sheets are stacked.

The waiting position of the guiding unit 115 is preferably the center of the sheets stacked on the stacker trays 112*a* or 112*b* because the stacking will be stabilized at the position. However, the waiting position is not limited to the center of the stacked sheets so long as the sheets are stacked within the stacker trays 112*a* and 112*b*.

Figure 9:
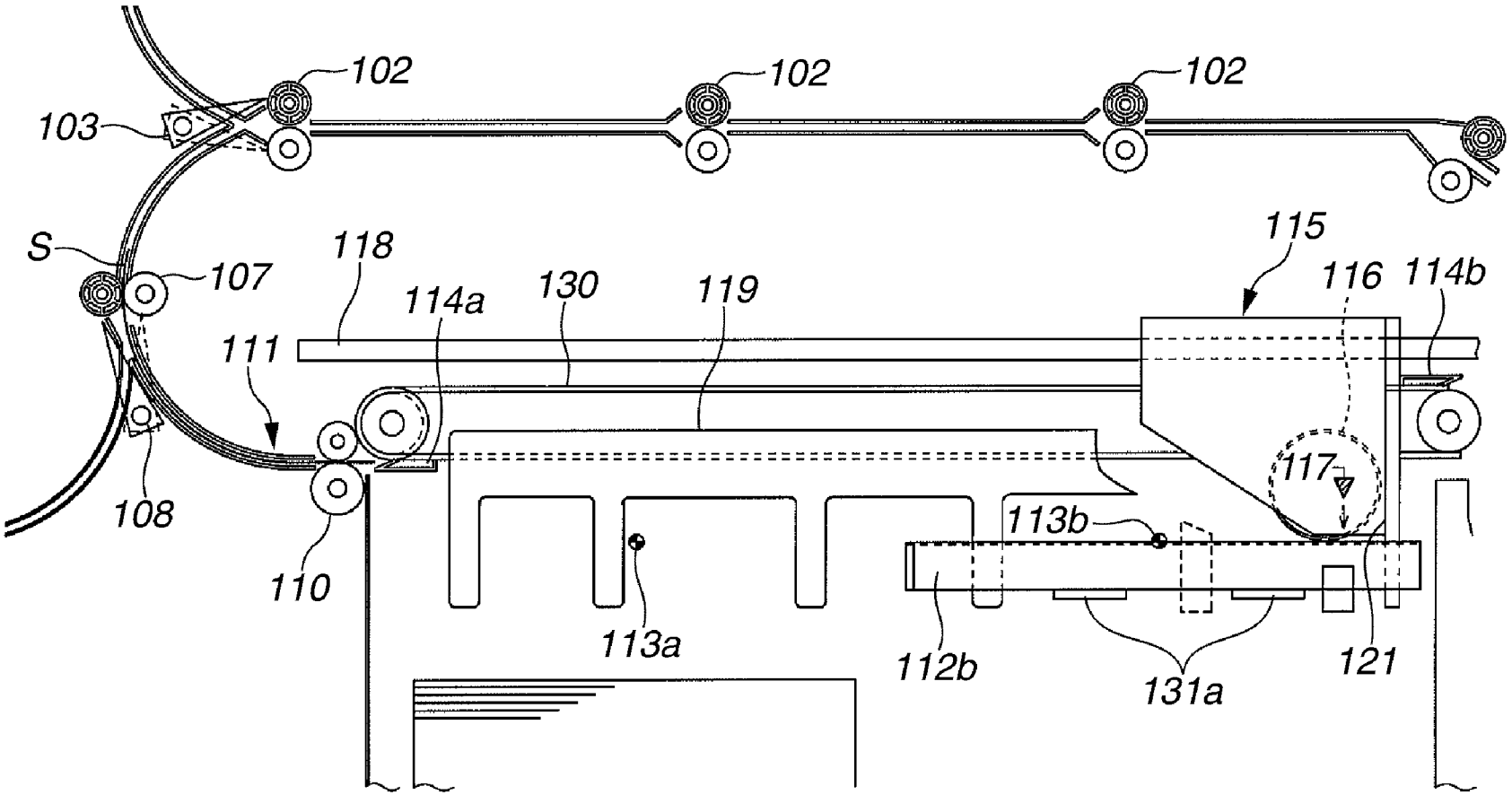
FIG. 9 illustrates movement of the sheets stacked on a stacker tray on the right. A sheet is held by a gripper.
Figure 10:
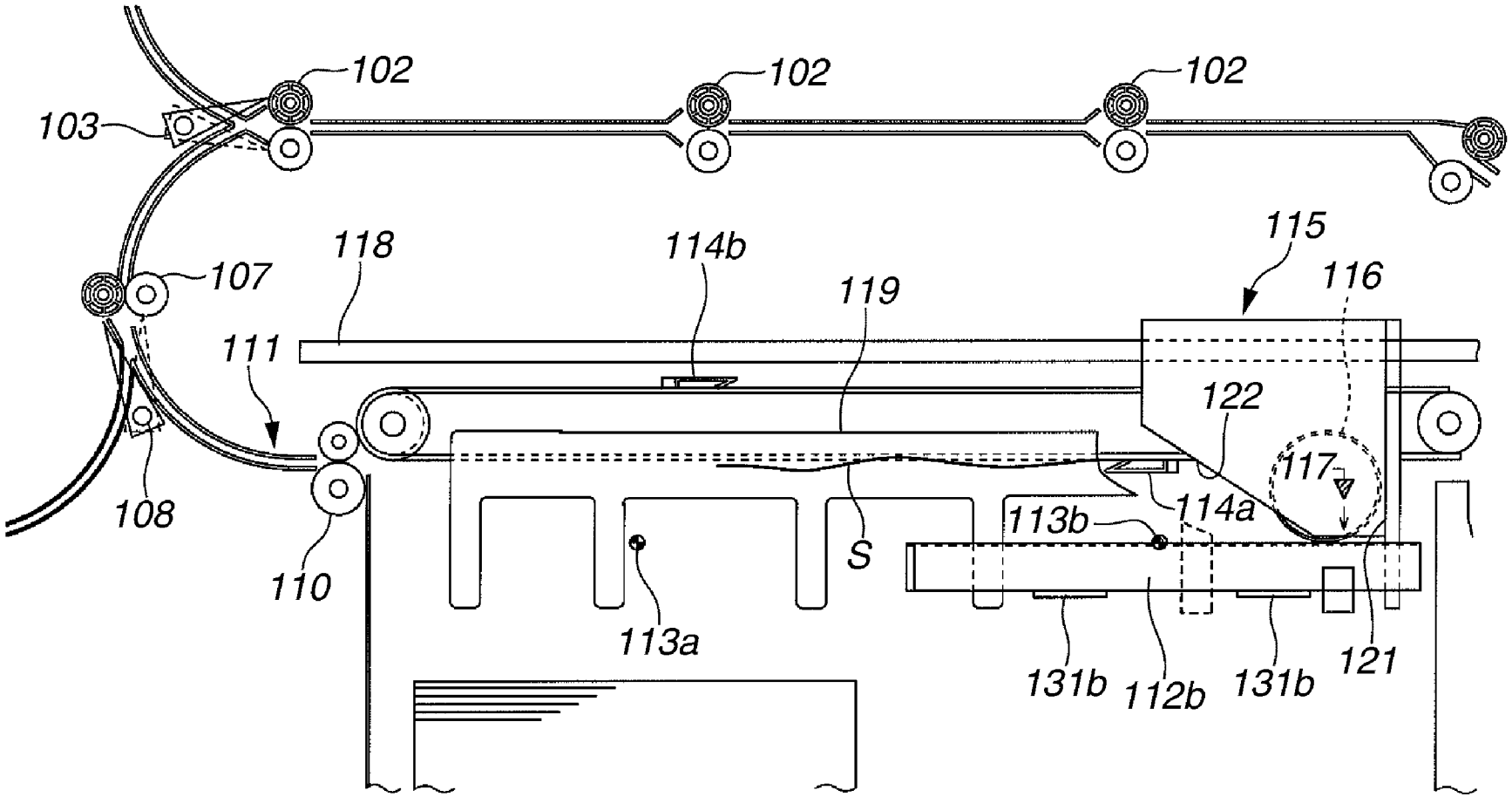
FIG. 10 illustrates movement of the sheet being conveyed to the guiding unit.
Figure 11:
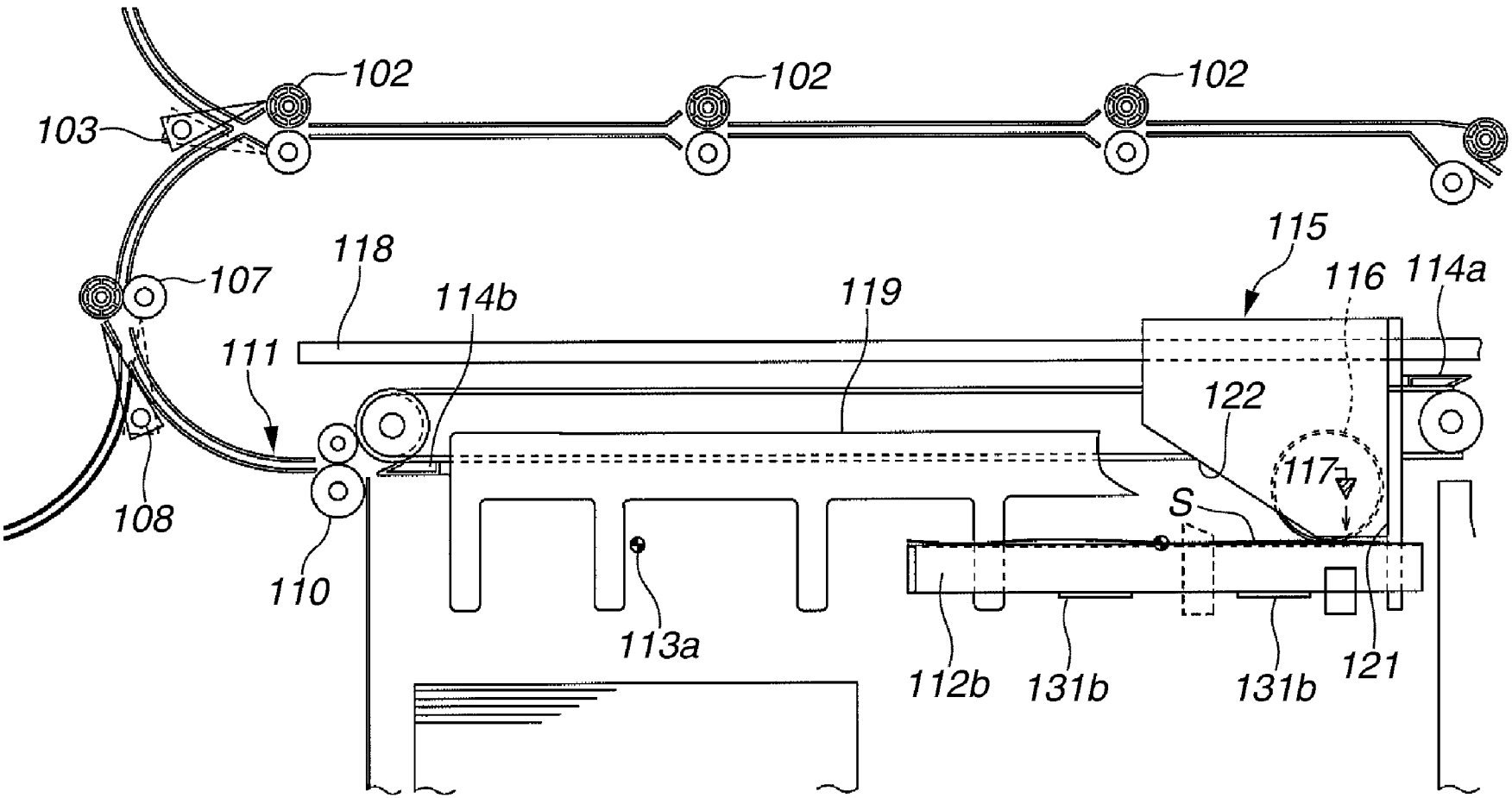
FIG. 11 illustrates movement of the sheet stacked on the stacker tray after being guided by the taper portion of the guiding unit.

As shown in FIG. 9, after the sheet is discharged from the apparatus main body 900A of the image-forming apparatus, the sheet is conveyed through the timing sensor 111 and conveyed from the discharge roller pair 110, where the leading edge of the sheet is gripped by the gripper 114*a*. As shown in FIGS. 10 and 11, when the gripper 114*a* passes the taper portion 122 of the guiding unit 115, the leading edge of the sheet S is urged by the taper portion 122 toward the stacker tray 112*b*. Then, the sheet is conveyed along the taper portion 122 and guided to the knurled belt 116.

Then, the leading edge of the sheet S abuts against the stopper 121 pulled by the knurled belt 116. The leading edge of the sheet S is aligned, and stacked onto the stacker tray 112*b*. Further, the alignment plate 119 aligns the side end of the sheet.

The sheet-surface-detection sensors 117 and 113*b* continuously monitor the top surface of the sheet stack on the stacker tray 112*b*. When a distance between the knurled belt 116 of the guiding unit 115 and the sheet becomes shorter than a predetermined distance, a stacker-tray-driving device (not shown) moves the stacker tray 112*b* down a predetermined distance. In this way, the distance between the sheet and the knurled belt 116 is kept constant.

Figure 4:
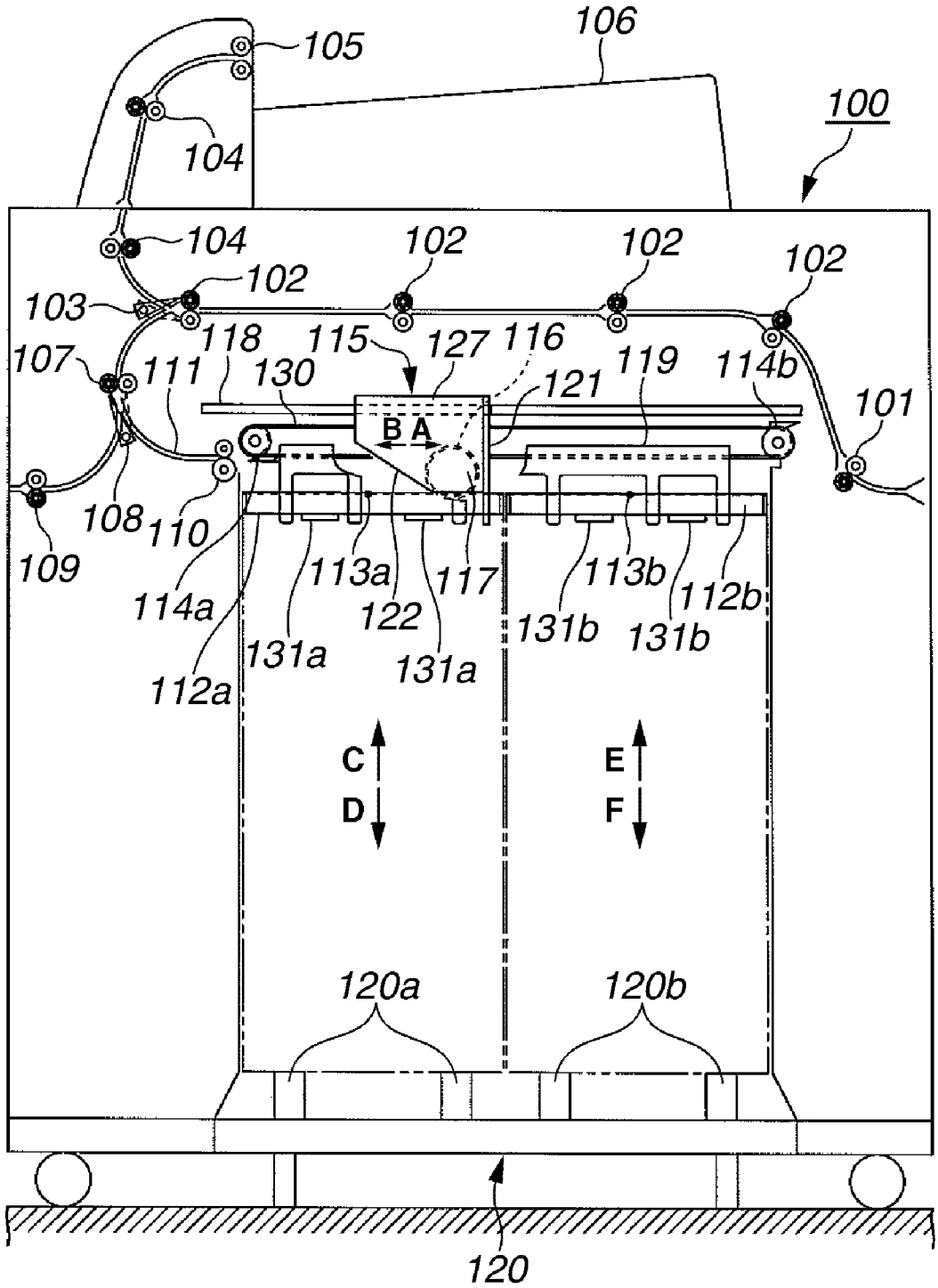
FIG. 4 is a cross-sectional view of the sheet-stacking apparatus in the sheet-conveyance direction according to an exemplary embodiment of the present invention.
Figure 12:
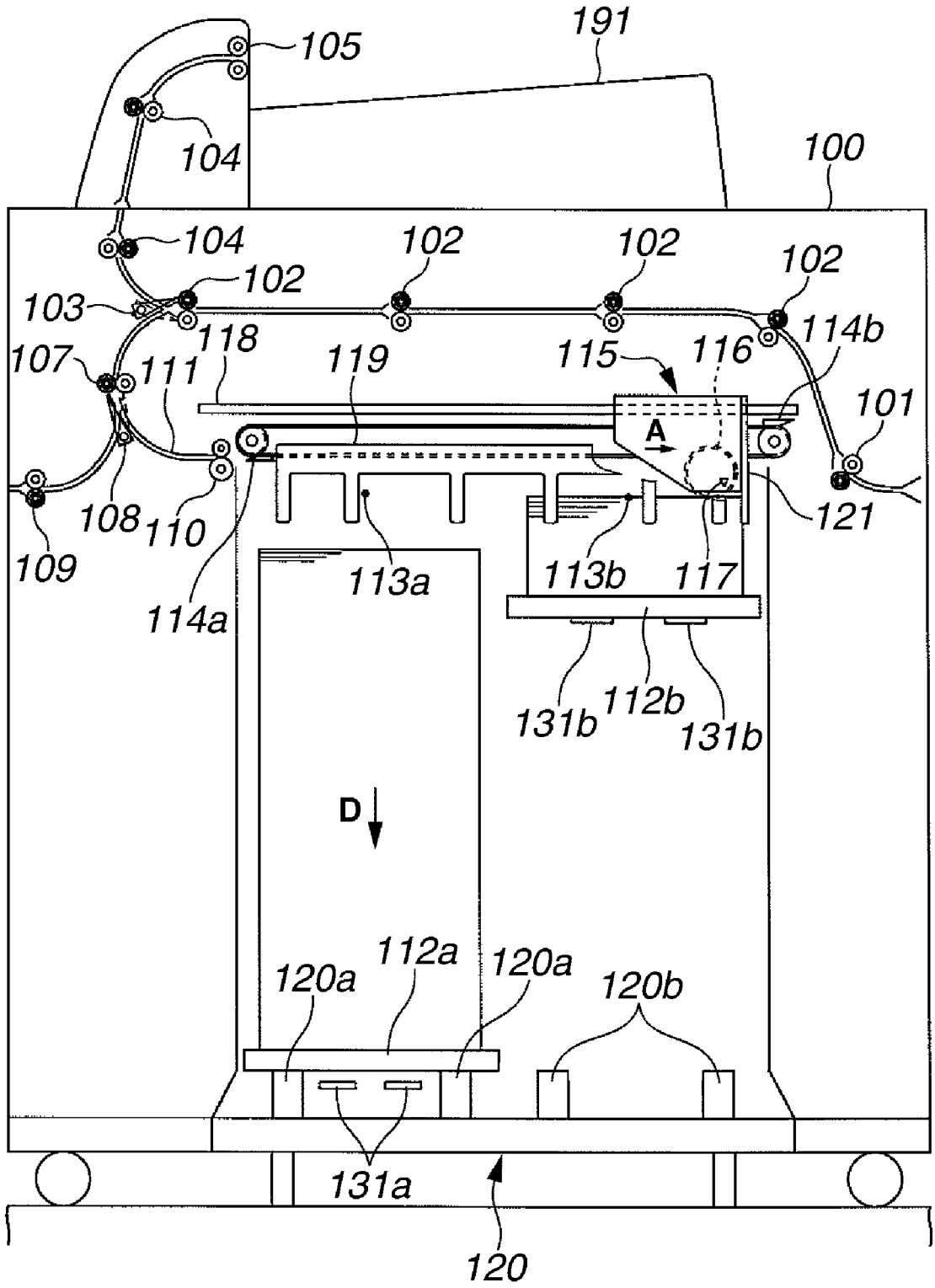
FIG. 12 illustrates a dolly mounted stacker tray on the left with sheets stacked to a predetermined stack height and a stacker tray on the right with stacked sheets.
Figure 13:
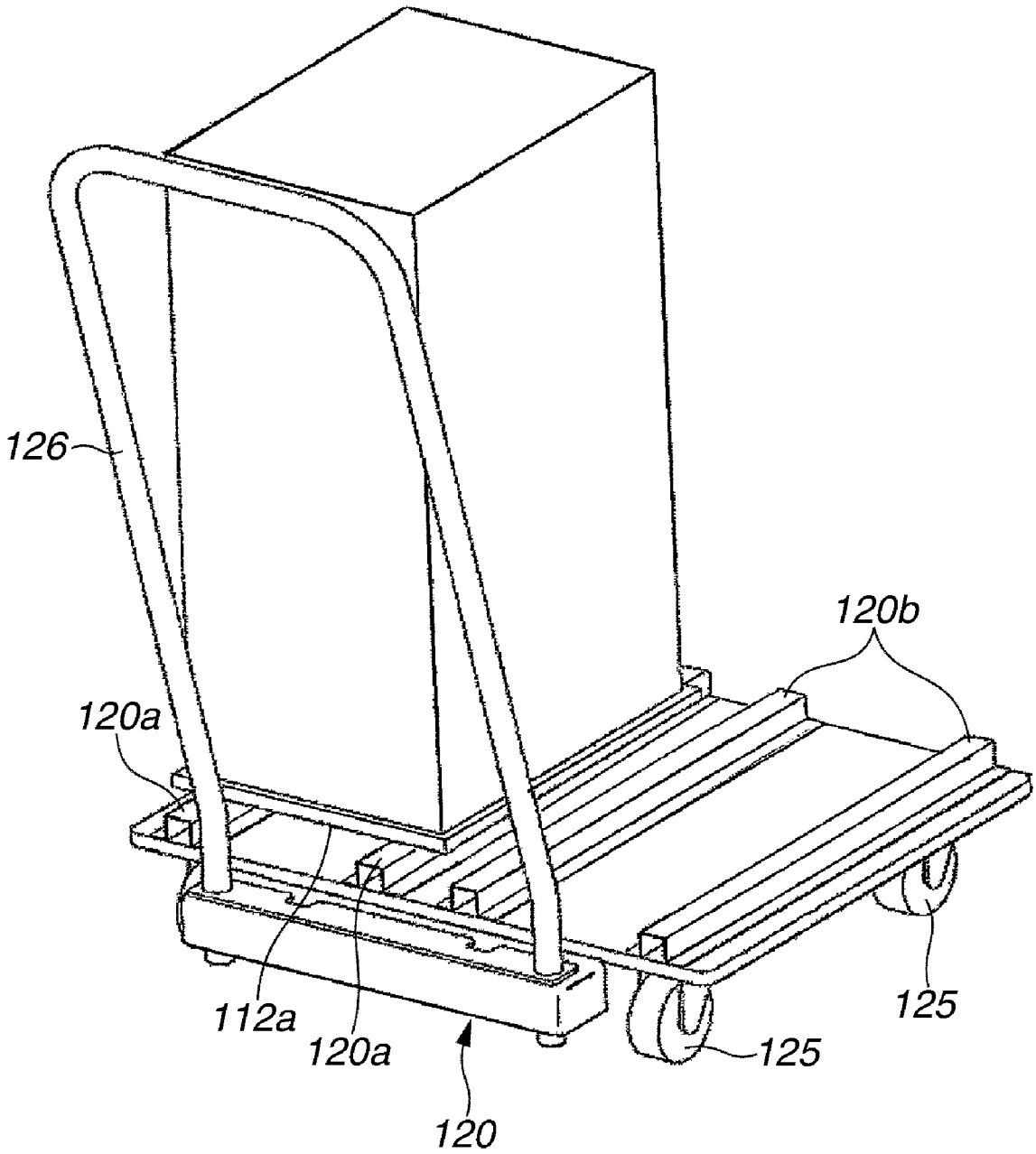
FIG. 13 illustrates removal of a dolly mounted stacker tray, stacked on the left-hand side with sheets stacked to a predetermined stack height.

In FIGS. 4 and 12, the stacker trays 112*a* and 112*b* are supported by two pairs of supporting members 131*a* and 131*b*. Each pair of supporting members 131*a* and 131*b* separately moves up and down driven by a driving device (not shown). When the sheets on the stacker tray 112*a* reach a predetermined stack height, the supporting member 131*a* moves down below a support surface 120*a* of the dolly 120 so that the stacker tray 112*a* is passed onto the dolly 120 at a predetermined take-out position. As shown in FIG. 13, the stacker tray 112*a* having a large number of sheets is mounted onto the dolly 120 using a fixing member (not shown) such as a pin arranged on a top surface of the dolly 120 so that the sheets do not fall off the dolly 120. The dolly 120 is provided with a caster 125 and a handle 126. By moving the dolly 120 holding its handle 126, a user can easily carry a large number of sheets at a time.

FIG. 12 illustrates the sheet-stacking apparatus where sheets are stacked on the stacker tray 112*b* after sheets were stacked to a predetermined stack height on the stacker tray 112*a*. The stacker tray 112*a* with the sheets stacked to a predetermined stack height moves down in the direction of arrow D to the take-out position to be mounted on the dolly 120. The user rolls out the dolly 120 mounted with the stacker tray 112*a* including the sheets as shown in FIG. 13.

After the dolly 120 is rolled out from the stacker apparatus 100, the sheet stack on the stacker tray 112*a* is removed by the user. The dolly 120 with the empty stacker tray 112*a* is set at a lower part of the stacker apparatus 100. The stacker tray 112*a* is supported by a pair of support members 131*a*.

While the user is removing the sheets on the stacker tray 112*a*, the stacker apparatus 100 stacks the sheet one after another on the stacker tray 112*b* with the grippers 114*a* and 114*b* which conveys and discharges the sheets alternately in accordance with the circulation of the drive belt 130. Since the user can remove the sheets without stopping the sheet-stacking operation, a large amount of sheets can be stacked continuously.

When the sheets stacked on the stacker tray 112*b* reach a predetermined stack height, the stacker tray 112*b* is determined to be fully loaded. The height is normally detected by the stacker-control unit 210 (FIG. 2) which counts a number of sheets conveyed from the discharge roller pair 110. The discharge timing of the sheets is detected by the timing sensor 111. Whether the predetermined stack height is reached can also be determined by detecting positions of the stacker tray 112*a* and the top surface of the sheet stack.

Figure 14:
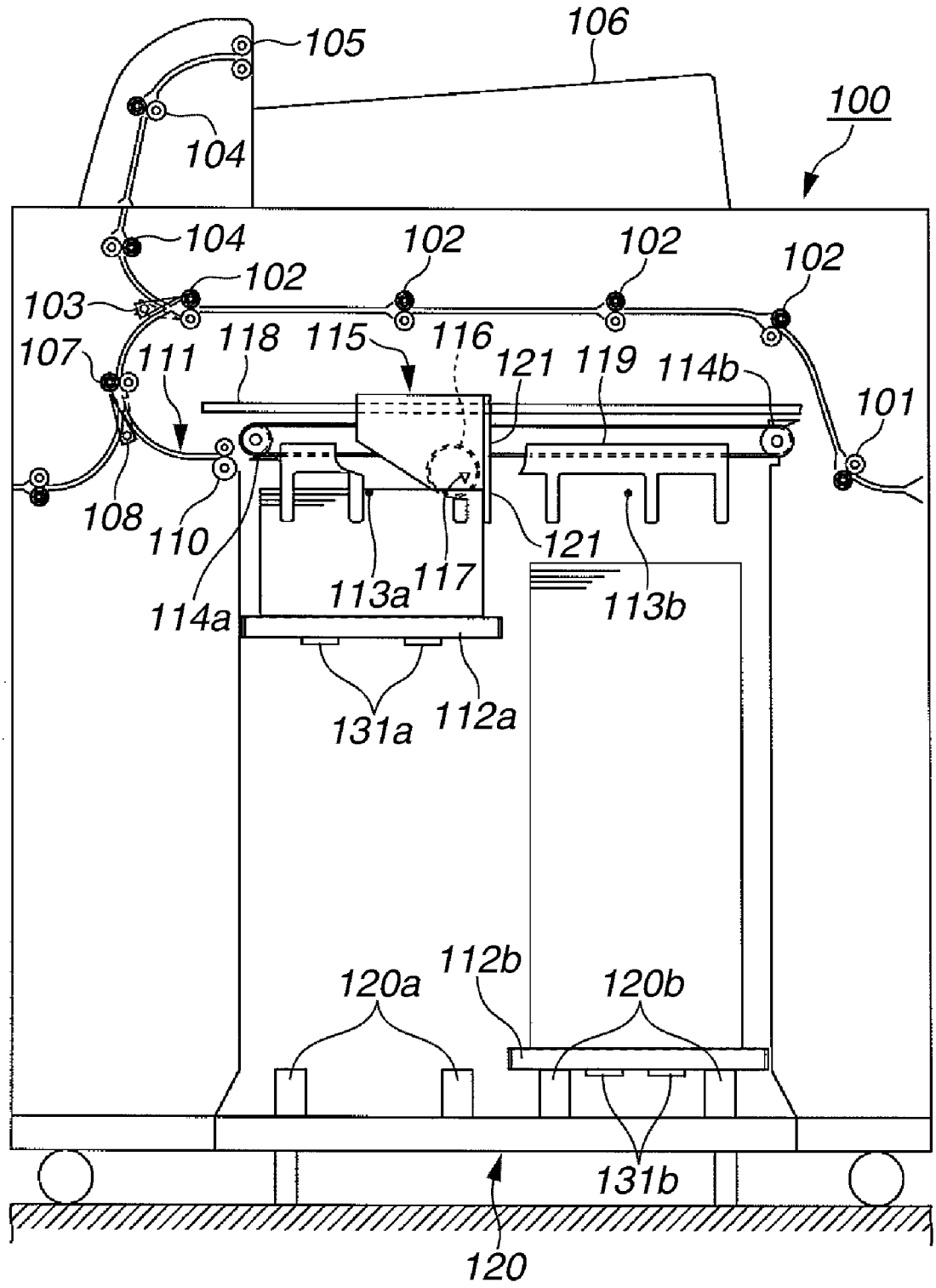
FIG. 14 illustrates a dolly mounted stacker tray, stacked on the right-hand side with sheets stacked to a predetermined stack height, and a stacker tray on the left-hand side with sheets being stacked.
Figure 15:
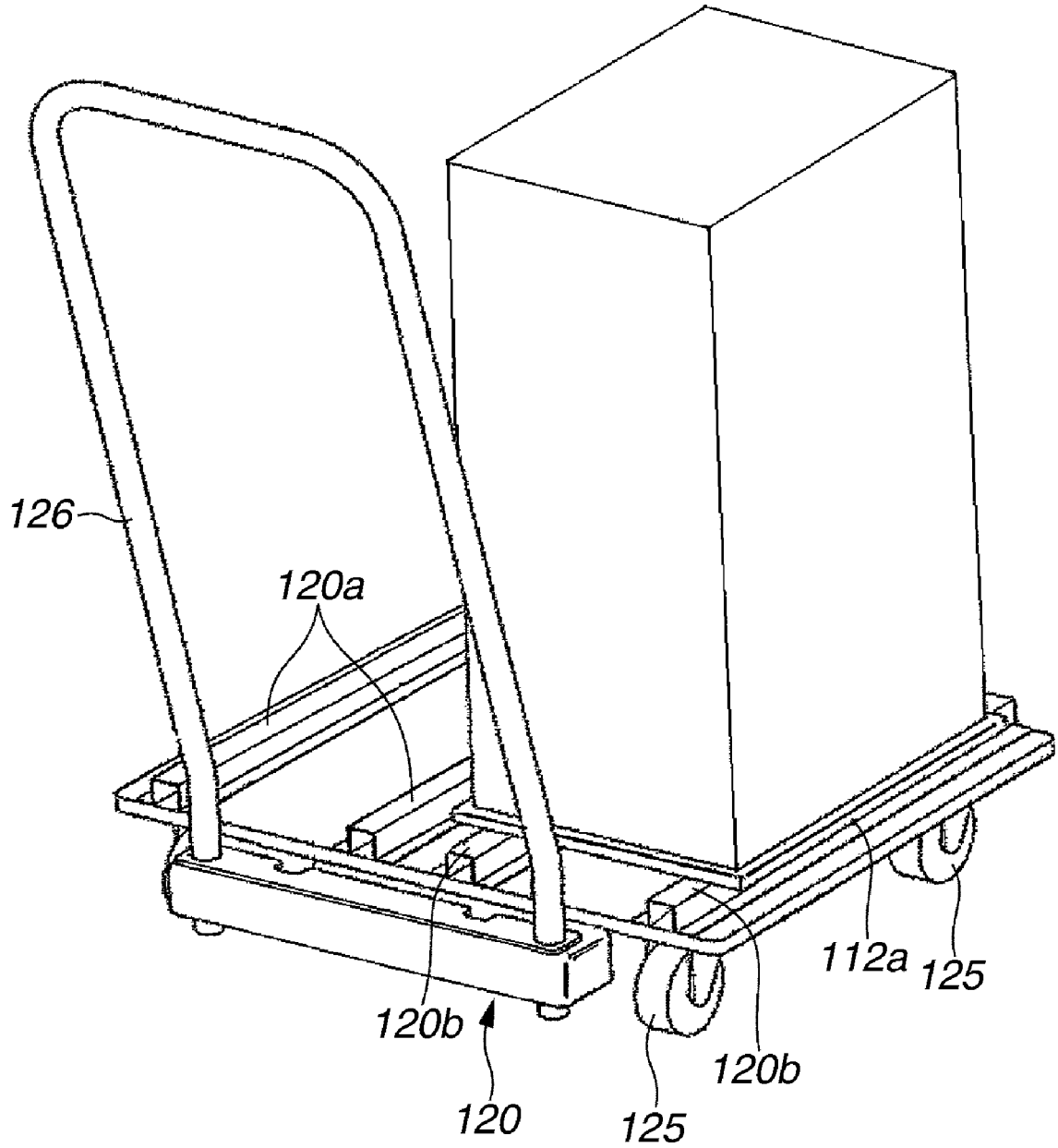
FIG. 15 illustrates removal of a dolly mounted stacker tray, stacked on the right-hand side with sheets stacked to a predetermined stack height.

When the sheets stacked on the stacker tray 112*b* reach a predetermined stack height, since the stacker tray 112*a* which previously had sheets stacked to a predetermined stack height is now empty, the guiding unit 115 moves again to the stacker tray 112*a* as shown in FIG. 14. The stacker tray 112*b* which is determined to be fully loaded is moved down to a predetermined take-out position by a pair of support members 131*b* which comes down as shown in FIG. 14, and mounted onto a support surface 120*b* of the dolly 120. As shown in FIG. 15, the stacker tray 112*b* with the stack of sheets is carried out by the dolly 120.

As described above, the stacker apparatus of the present invention allows a user to carry out the sheets stacked on a tray while sheets are being stacked on the other tray. Since the user can successively carry out the stack of sheets without stopping the stacking operation, stacking efficiency can be improved. In addition, efficiency in carrying out sheets can also be improved.

Figure 21:
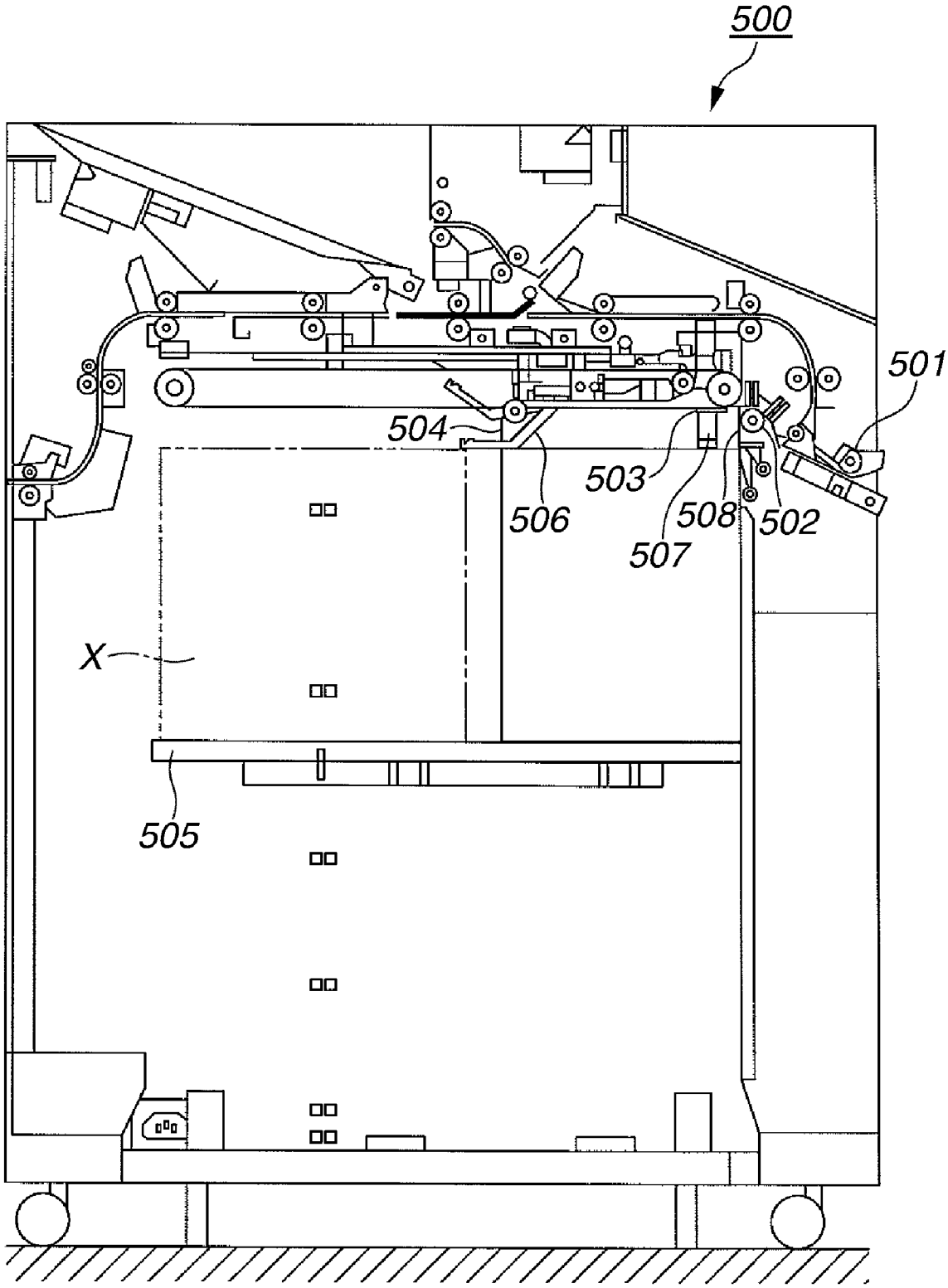
FIG. 21 is a cross-sectional view of a conventional sheet-stacking apparatus in a sheet-conveyance direction.

Further, since the sheet of a short length can be stacked on each of the stacker trays as a second mode, the area X (FIG. 21) where the sheet is not conventionally stacked can also be used for stacking, and thus the area in the stacker apparatus can be used more efficiently.

Furthermore, since the image-forming apparatus 900 of the present invention is equipped with a stacker apparatus which does not need to stop the sheet-stacking operation, continuous image forming can be accomplished, which enhances image forming efficiency.

Figure 16:
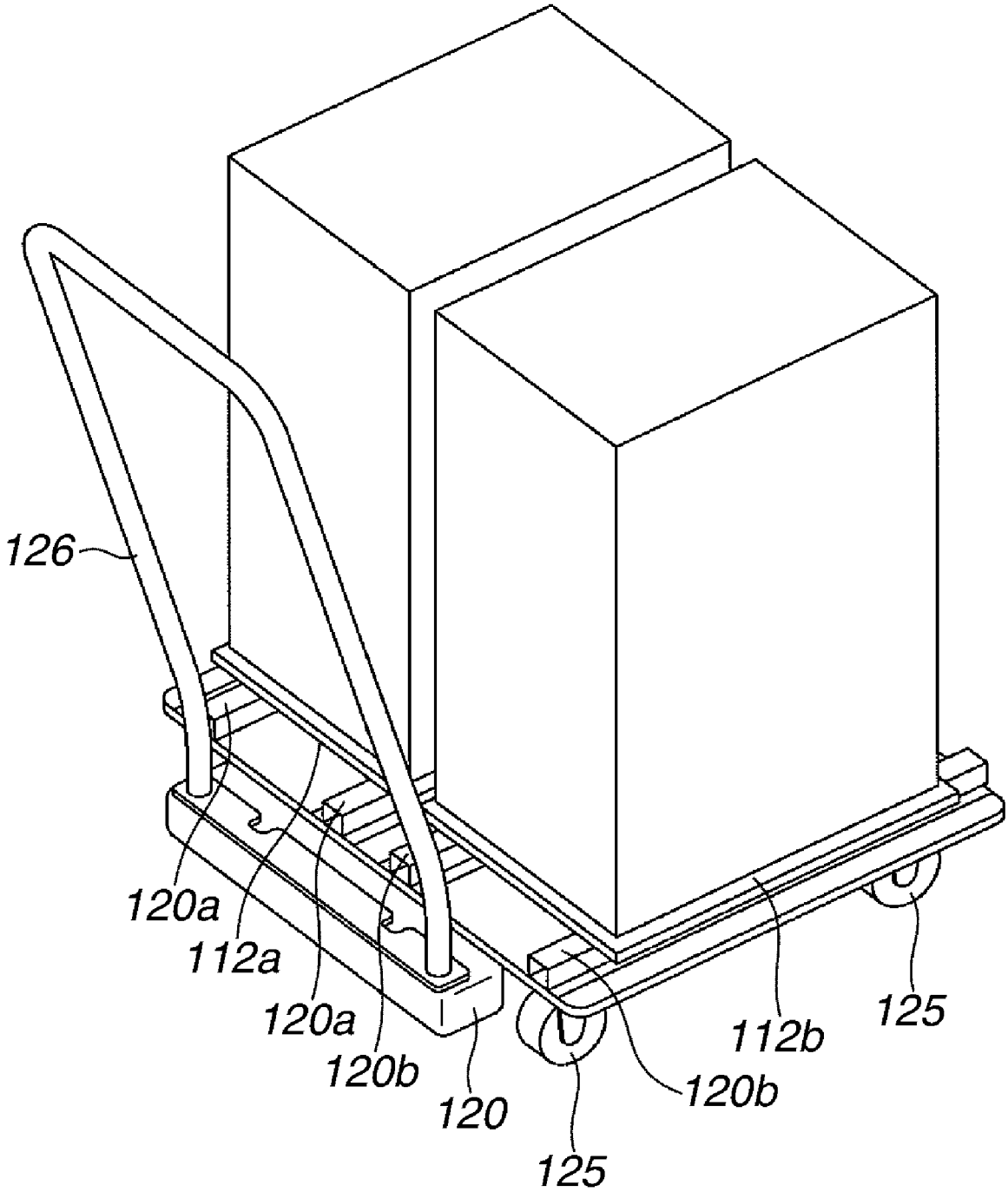
FIG. 16 illustrates removal of two dolly mounted stacker trays, stacked on the right-hand side and on the left-hand side. Sheets are separately stacked on each stacker tray.

The stacker apparatus described above allows a user to carry out sheets stacked to a predetermined stack height on a tray while sheets are being stacked on the other tray, which is referred to as a continuous run mode. Further, the sheet-stacking apparatus of the present invention allows a user to carry out two stacker trays whose stack of sheets have reached a predetermined stack height at the same time (FIG. 16). Furthermore, the tray can be taken out even if the sheet stack has not reached the predetermined stack height. For example, in a case where the sheets need to be taken out when a print job ends, the user can move the tray down to the take-out position by pressing a take-out button.

(Stacking sheets across two stacker trays as a first mode)

Figure 17:
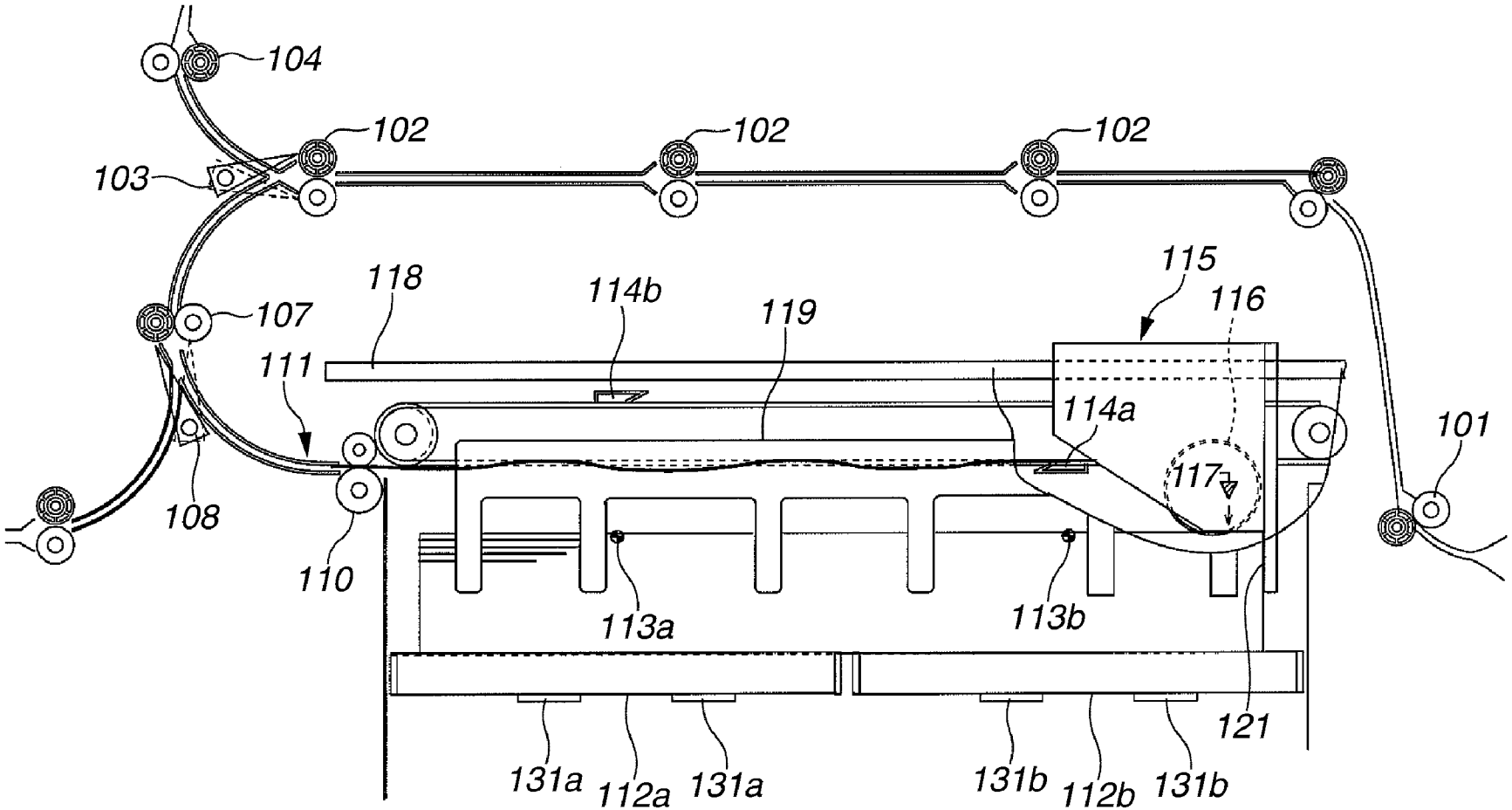
FIG. 17 illustrates sheets which are stacked across the right and the left stacker trays.
Figure 18:
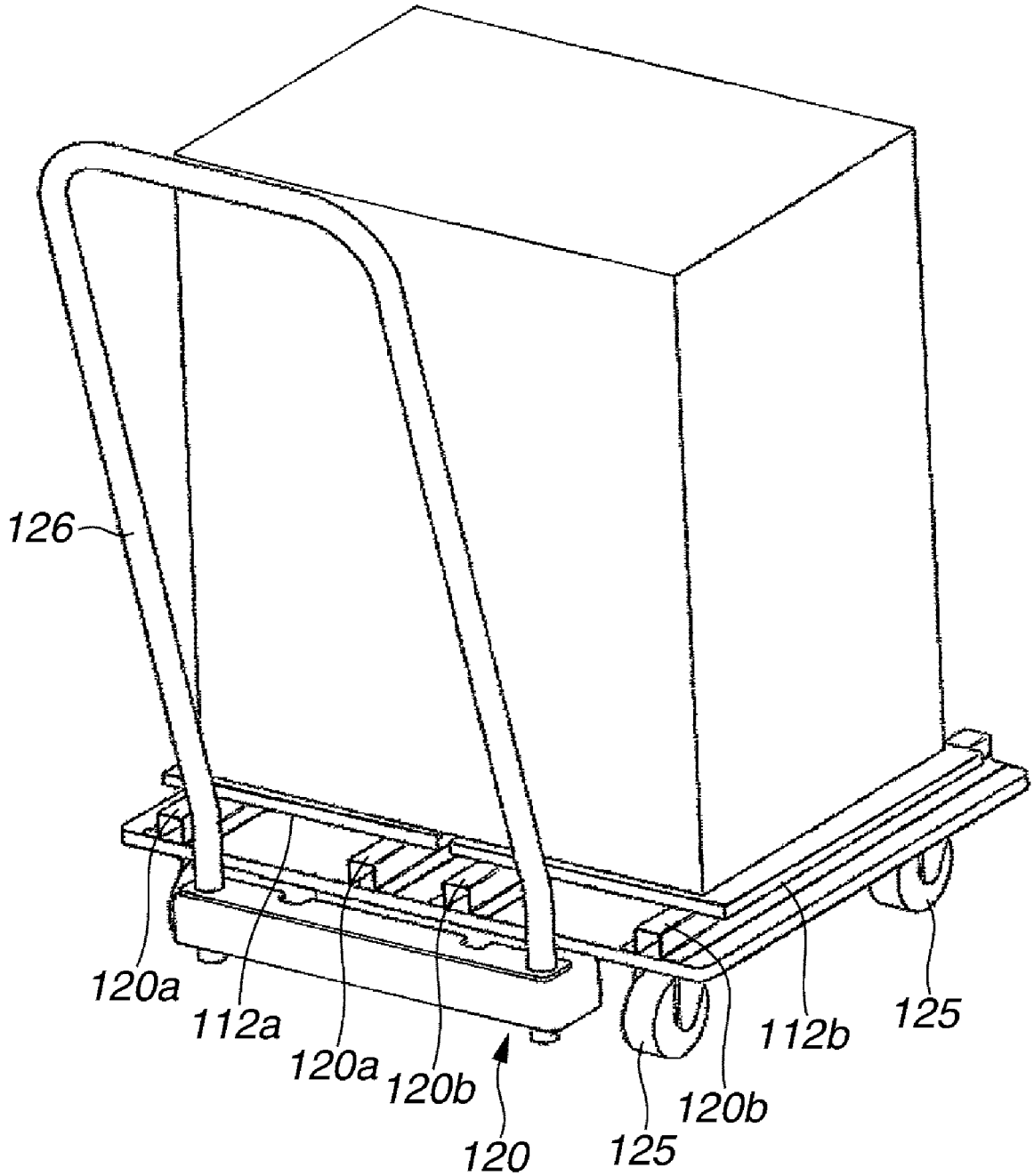
FIG. 18 illustrates carrying-out of a dolly mounted stacked sheet, stacked across right-hand and left-hand stacker trays.
Figure 19:
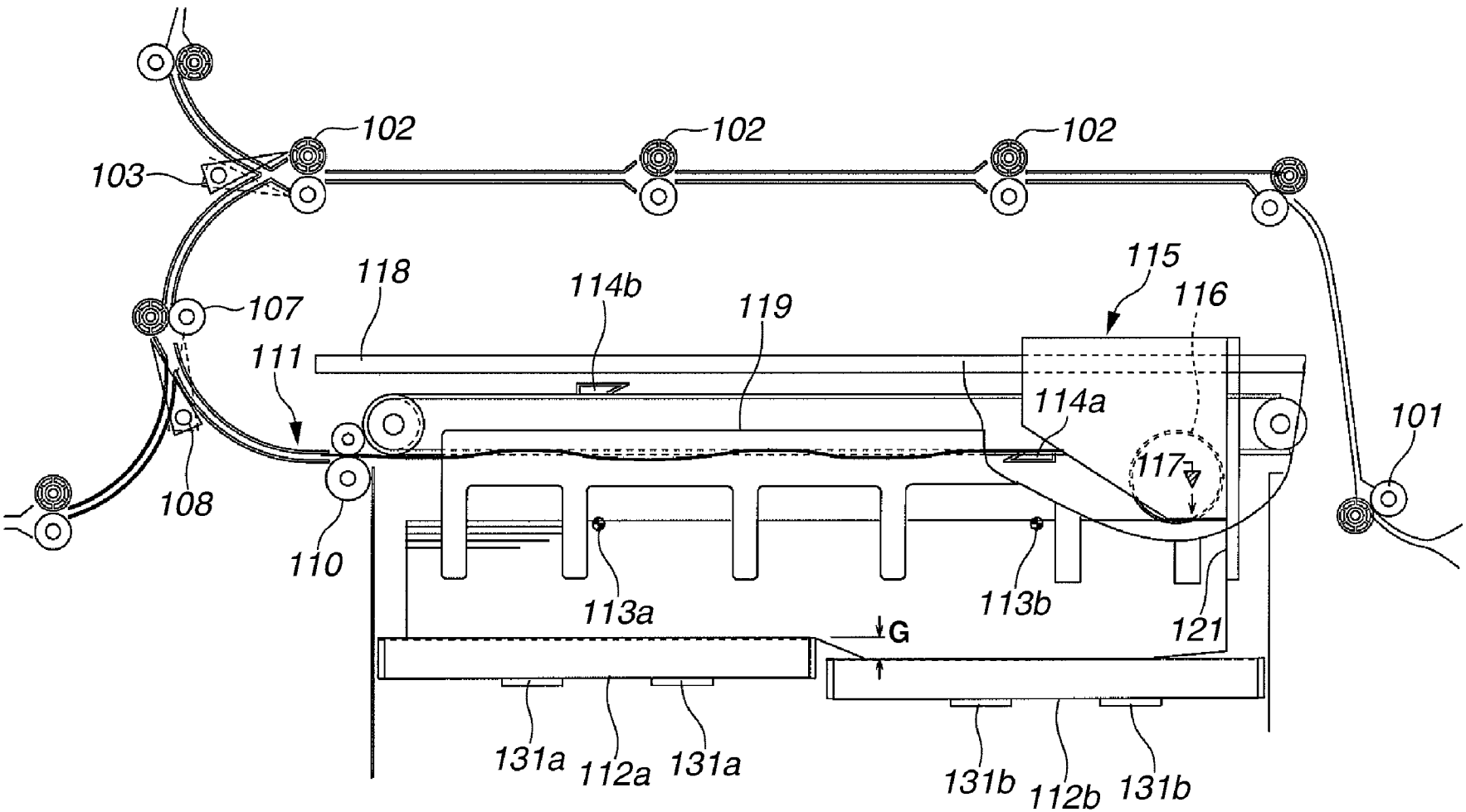
FIG. 19 illustrates an operation for reducing a curl of a sheet stacked across the right and the left stacker trays.

An operation of the sheet-stacking apparatus 100 when sheets are stacked across the stacker trays 112*a* and 112*b* is described according to FIGS. 17 through 19.

Before a sheet S is conveyed to the stacker apparatus 100, the stacker-control unit 210 (FIG. 2) receives information about the sheet (generally, sheet size, material, etc.) from the CPU circuit unit 206.

Based on the sheet size information, the stacker-control unit 210 determines onto which stacker tray the sheet is to be stacked or whether the sheet is to be stacked across the plural stacker trays. In other words, a number of stacker trays to stack the sheets is determined according to the length of the sheet along the direction of the arrangement of the stacker trays.

When the stacker-control unit 210 determines that the sheet is to be stacked across plural stacker trays, the stacker-control unit 210 makes the guiding unit 115 wait above the stacker tray 112*b* which is on a downstream side in a sheet conveying direction as shown in FIG. 17.

After the sheet is detected by a timing sensor 111, the sheet is held by the gripper 114*a* and conveyed to the guiding unit 115. The position of the top surface of the sheet stack on the stacker trays 112*a* and 112*b* is continuously detected by sheet-surface-detection sensors 117, 113*a*, and 113*b* as a detection unit. Consequently, according to a detection result of these sensors, the stacker trays 112*a* and 112*b* are moved down so that the top surface of the sheet stack remains level and consistently keeps a certain height.

When the top surface of the sheet stack on the stacker trays 112*a* and 112*b* reaches a predetermined stack height, both stacker trays 112*a* and 112*b* are moved down to a predetermined take-out position and then mounted on a dolly 120 and carried out as shown in FIG. 18.

After the dolly 120 is carried out from the stacker apparatus 100, the sheet stack on the stacker trays 112*a* and 112*b* on the dolly 120 is removed by the user. The stacker apparatus 100 is stopped until the dolly 120 is set at the stacker apparatus 100 again. Alternatively, a spare dolly 120 and spare stacker trays 112*a* and 112*b* can be prepared at the stacker apparatus 100. The spare dolly 120 enters the stacker apparatus 100, and the spare stacker trays 112*a* and 112*b* can be supported by the supporting members 131*a* and 131*b* in operating the stacker apparatus 100.

Accordingly, since the top surface of the sheet stack on the stacker trays 112*a* and 112*b* is kept at a certain height in the stacker apparatus 100 according to the exemplary embodiments of the present invention, sheets can be easily stacked on the stacker trays 112*a* and 112*b*.

Further, when the sheets stacked across the stacker trays 112*a* and 112*b* reach a predetermined stack height, the sheets are carried out on the dolly 120 together with the stacker trays 112*a* and 112*b* as shown in FIG. 18. Therefore, efficiency in carrying out the sheets can be improved.

Since the stacker apparatus 100 is equipped with two stacker trays 112*a* and 112*b* which separately move up and down, the stacker apparatus 100 can also perform the following operations.

The sheet S conveyed from the apparatus main body 900A of the image-forming apparatus often has a curl in its leading edge, middle portion, or trailing edge.

FIG. 19 illustrates a sheet having an upward curl in its leading edge and stacked across on the stacker trays 112*a* and 112*b*.

In the conventional stacking apparatus, if the sheets are stacked on only one stacker tray, when a sheet has a curl, it is difficult to prevent a curled portion from protruding beyond an upper limit of the stack height which is set so that the next sheet does not contact the stacked sheets. Especially, a large sheet which is longer in the conveying direction has a greater amount of curl protruding beyond the upper limit. The sheets of the stacker apparatus 100 can be stacked across two stacker trays 112*a* and 112*b* and a portion of the sheets over each of stacker trays 112*a* and 112*b* is detected by the surface detection sensors 117, 113*a*, and 113*b*. Accordingly, based on detection by the sheet-surface-detection sensors 117, 113*a*, and 113*b* as a detection unit, the two stacker trays 112*a* and 112*b* can be moved up and down separately so as to prevent such a curled portion from protruding beyond the upper limit of the stack height.

For example, if the upstream side of the sheet is curled upward and protrudes beyond the upper limit of the stack height, the stacker tray 112*a* located upstream of the stacker tray 112*b* in a sheet conveying direction is moved down to prevent the curled portion from protruding. Similarly, if the downstream side of the sheet is curled upward, the stacker tray 112*b* located downstream of the stacker tray 112*a* in a sheet conveying direction is moved down to prevent the curled portion from protruding.

Thus, since the stacker tray 112*a* on the upstream side in a sheet conveying direction is moved down to prevent an upward curl on the upstream edge from protruding, the subsequent sheet can be stacked smoothly, which prevents sheet jam from occurring in the subsequent sheet.

Further, while the stacker apparatus 100 of the present invention has three sheet-surface-detection sensors 117, 113*a*, and 113*b* as a detection unit, configured to detect a sheet surface of the sheets stacked in the stacker trays 112*a* and 112*b*, the number of the sheet-surface-detection sensors can be increased to further reduce the amount of protrusion.

Further, when the upstream stacker tray 112*a* of the stacker apparatus 100 according to the embodiments of the present invention is moved down to prevent the upstream edge from protruding, the downstream stacker tray 112*b* is controlled not to move down. Therefore, according to the stacker apparatus 100 of the present invention, even when a projection of a sheet at the upstream edge is prevented, the distance between the guiding unit 115 and the top surface of the sheet stack on the downstream side can be kept constant. Accordingly, the knurled belt 116 causes the leading edge of the sheet to reliably contact the stopper 121, and the alignment of the sheet leading edge is maintained.

It is to be noted that when the stacker trays 112*a* and 112*b* are moved up and down separately according to the curl of the sheet, a step height (difference between heights) G occurs between the stacker trays (FIG. 19). In this case, even if the stacker trays can stack the sheets, there is no step height between the stacker trays 112*a* and 112*b* when the stacker trays are mounted on the dolly 120. Accordingly, if the step height between the stacker trays becomes too large, an original curl reappears on the sheets on the stacker trays 112*a* and 112*b* when mounted on the dolly 120. This reduces stacking stability and significantly degrades appearance of the sheets.

Therefore, in order to make a curl of a sheet flat, the stacker-control unit 210 (FIG. 2) serving as a controller calculates the step height between the stacker trays based on a driving amount of the driving device when the stacker tray moves up or down. Then, when the step height exceeds a predetermined amount, the stacking operation is stopped. Alternatively, an operation unit 209 serving as a notification unit performs display (notifies) that the curl exceeds the predetermined amount, and asks the user whether to stop or continue the stacking operation. Having at least one of these functions, the stacker apparatus 100 can stack sheets without degrading appearance.

Figure 20:
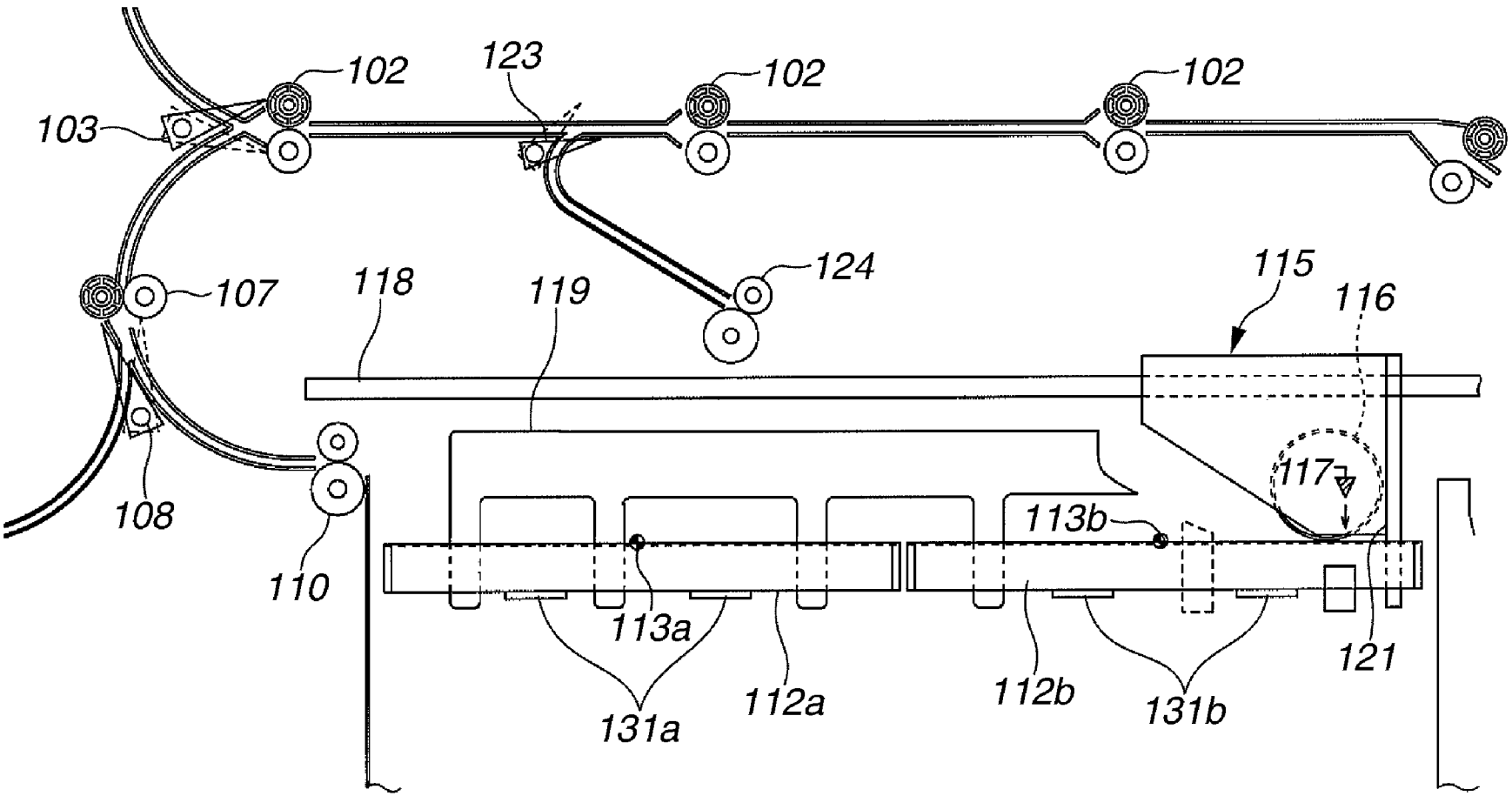
FIG. 20 illustrates a sheet-stacking apparatus provided with a sheet conveying section for each stacker tray.

In the stacker apparatus described above, a gripper conveys the sheet to a plurality of stacker trays. However, as shown in FIG. 20, each stacker tray can be provided with the discharge roller pair 110 and a discharge roller pair 124 serving as a conveying portion, and the sheet can be conveyed from these roller pairs to each stacker tray.

In this case, when sheets are stacked on the stacker tray 112*a*, the guiding unit 115 is configured to wait above the stacker tray 112*a*. The sheet conveyed by the discharge roller pair 110 is discharged toward the guiding unit 115. When sheets are stacked on the stacker tray 112*b*, the guiding unit 115 is configured to wait on the stacker tray 112*b* and the sheet is conveyed by the discharge roller pair 124 toward the guiding unit 115. The selection of the discharge roller pair 110 and the discharge roller pair 124 is made by switching a switching member 123.

Further, according to the present embodiments, the stacker apparatus has two stacker trays, however, the stacker apparatus can have three or more stacker trays. Depending on a length of the sheet in the sheet-conveying direction, the sheet can be stacked across three or more stacker trays at a time.

Furthermore, while the grippers grip the leading edge to convey the sheet according to the present embodiments, an air suction apparatus can alternatively be arranged on the drive belt 130 to convey the sheet in place of the grippers. In this case, the air suction apparatus serving as an air suction unit sucks the leading edge of the sheet. Moreover, an electrostatic attraction apparatus can be arranged on the drive belt 130 to hold the leading edge of the sheet using static electricity and convey the sheet.

A further embodiment of the invention provides a sheet-stacking apparatus comprising: a conveying portion configured to convey a sheet; a plurality of stacking portions configured to stack different sheets conveyed by the conveying portion individually, the plurality of stacking portions being capable of stacking a same sheet conveyed by the conveying portion; and an elevating device configured to separately move the plurality of stacking portions up and down.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application Nos. 2006-242076 filed Sep. 6, 2006 and 2007-214886 filed Aug. 21, 2007, which are hereby incorporated by reference herein in their entirety.

What is claimed is:

1. A sheet-stacking apparatus comprising:

a conveying portion configured to convey a sheet;

a plurality of stacking portions, each stacking portion suitable for holding a stack of sheet;

an elevating device configured to individually move the plurality of stacking portions up and down, wherein a sheet conveyed by the conveying portion is capable of being stacked on each stacking portion, and the sheet-stacking apparatus is operable to stack a sheet across the plurality of stacking portions; and at least one of a notification portion configured to make a notification when the stacking portions with a sheet stacked across are moved down individually and a difference in height between a highest stacking portion and a lowest stacking portion becomes greater than a predetermined value, and a controller configured to stop a stacking operation when the stacking portions with sheets stacked across are moved down individually and a difference in height between a highest stacking portion and a lowest stacking portion becomes greater than a predetermined value.

2. A sheet-stacking apparatus according to claim 1, wherein a number of stacking portions used to stack the sheets from the conveying portion is determined according to the length of the sheet along a direction of the arrangement of the stacking portions.

3. A sheet-stacking apparatus according to claim 2, wherein if a length of a sheet to be conveyed along the direction of arrangement of the stacking portions enables stacking of a sheet on one stacking portion, the sheet to be conveyed is stacked selectively on one stacking portion out of the plurality of stacking portions, and wherein if a length of a sheet to be conveyed along the direction of arrangement of the stacking portions does not enable stacking of a sheet on one stacking portion, the sheet to be conveyed is stacked across a plurality of stacking portions.

4. A sheet-stacking apparatus according to any one of claim 1, wherein the stacking portions can be taken out from the sheet-stacking apparatus.

5. A sheet-stacking apparatus according to claim 4, wherein while a stacking portion is being taken out, a conveyed sheet can be stacked on another stacking portion of the plurality of stacking portions.

6. A sheet-stacking apparatus according to claim 1, wherein the stacking portions can be taken out from the sheet-stacking apparatus in the case that the stacking portions move to a predetermined take-out position;

wherein if one stacking portion moves to the predetermined take-out position, the one stacking portion can be taken out; and wherein if two or more stacking portions are moved to the predetermined take-out position, the two or more stacking portions can be taken out at a time.

7. A sheet-stacking apparatus according to claim 6, wherein the stacking portion which is moved to the take-out position can be removed by a dolly set under the stacking portion.

8. A sheet-stacking apparatus according to claim 1, further comprising, a detection unit provided for each of the plurality of stacking portions and configured to detect a position of a top surface of the sheet stack on each of the stacking portions, wherein if a sheet is stacked across two or more stacking portions, the sheet-stacking apparatus is configured so that the sheet-stacking portion is moved down separately depending on a detection result of the detection unit to adjust the position of the top surface of the sheet stack.

9. A sheet-stacking apparatus according to claim 1, further comprising:

a plurality of detection unit provided for each of the plurality of stacking portions and configured to detect a position of a top surface of the sheet stack on each of stacking portions, and a guiding unit configured to guide the sheet conveyed from the conveying portion to a predetermined position on a stacking portion selected from the plurality of stacking portions, wherein in the case that the conveyed sheet is stacked across the selected stacking portion and a stacking portion upstream of the selected stacking portion in the sheet conveying direction of the conveying portion, if the detection unit detects that the top surface of the sheet stack on the upstream stacking portion is higher than a predetermined stack height, the upstream stacking portion is moved down so that the position of the top surface of the sheet stack on the upstream stacking portion can be adjusted.

10. A sheet-stacking apparatus according to claim 1, wherein the conveying portion moves from a predetermined waiting position while holding the sheet, to convey the sheet to a selected stacking portion.

11. A sheet-stacking apparatus according to claim 1, wherein the conveying portion is provided for each of the stacking portions.

12. A sheet-stacking apparatus according to claim 9, wherein the guiding unit includes a guide member configured to guide a sheet to the stacking portion and an rotating body configured to move the sheet.

13. A sheet-stacking apparatus according to claim 9, further comprising a stopper configured to stop a leading edge of the sheet guided by the guiding unit at the predetermined position.

14. An image-forming apparatus comprising:

an image-forming unit configured to form an image on a sheet; and a sheet-stacking apparatus configured to stack an image-formed sheet according to claim 1.

* * * * *